US007117701B2

(12) United States Patent
Armstrong et al.

(10) Patent No.: US 7,117,701 B2
(45) **Date of Patent: *Oct. 10, 2006**

(54) DEVICES, METHODS, AND SYSTEMS FOR KEYING A LOCK ASSEMBLY

(75) Inventors: Steve Armstrong, Anaheim Hills, CA (US); Gerald B. Chong, Rowland Heights, CA (US)

(73) Assignee: Newfrey LLC, Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/958,081

(22) Filed: Oct. 4, 2004

(65) Prior Publication Data

US 2005/0039507 A1 Feb. 24, 2005

Related U.S. Application Data

(60) Division of application No. 10/384,294, filed on Mar. 7, 2003, now Pat. No. 6,862,909, which is a continuation-in-part of application No. 10/256,066, filed on Sep. 26, 2002, now Pat. No. 6,860,131.

(51) Int. Cl.
*E05B 27/06* (2006.01)
*E05B 29/04* (2006.01)

(52) U.S. Cl. ..... 70/492; 70/383; 70/384; 70/493; 70/495

(58) Field of Classification Search ..... 70/337–343, 70/382–385, 368, 492, 493, 495
See application file for complete search history.

(56) References Cited

U.S. PATENT DOCUMENTS 1,565,556 A 12/1925 Fremon
1,610,224 A 12/1926 Dalboni et al.
1,965,889 A 7/1934 Fitzgerald
2,139,842 A 12/1938 Miller
2,194,469 A 3/1940 Fremon
2,232,017 A 2/1941 Wilder
2,370,862 A 3/1945 Johnstone
2,391,832 A 12/1945 Johnstone ..... 70/367
2,895,323 A 7/1959 Ernest ..... 70/383
2,977,786 A 4/1961 Kendrick et al.

(Continued)

FOREIGN PATENT DOCUMENTS

EP 0157967 10/1985

(Continued)

*Primary Examiner*—Lloyd A. Gall
(74) *Attorney, Agent, or Firm*—Richard J. Veltman; John D. DelPonti

(57) ABSTRACT

Certain exemplary embodiments of the present invention provide a lock keying system comprising: a lock cylinder comprising: a cylinder body; a plug assembly disposed in the cylinder body and comprising a plurality of pins and a one-to-one corresponding plurality of racks for relocating the plurality of pins; and a rack alignment tool receiving aperture defined by the lock cylinder; and a rack alignment tool comprising: a base plate; and a plurality of spaced elongated prongs, each prong from the plurality of prongs comprising a first longitudinal end adapted to engage a corresponding one of the plurality of racks, each prong from the plurality of prongs dimensioned lengthwise to relocate to a first predetermined position the corresponding one of the plurality of racks, the first predetermined position common to each of the plurality of racks, each prong from the plurality of prongs comprising a second longitudinal end connected to the base plate, wherein the rack alignment tool is adapted to restrain a carrier assembly comprising the plurality of racks in an unengaged position wherein the plurality of racks are unengaged with the plurality of pins.

16 Claims, 31 Drawing Sheets

U.S. PATENT DOCUMENTS

| | | | | |
|---|---|---|---|---|
| 3,149,486 | A | 9/1964 | Russell et al. | |
| 3,183,692 | A | 5/1965 | Check | 70/383 |
| 3,190,093 | A | 6/1965 | Schlage | |
| 3,320,781 | A | 5/1967 | Hill | 70/384 |
| 3,589,153 | A | 6/1971 | Hill | 70/384 |
| 3,667,262 | A | 6/1972 | Hill | 70/384 |
| 3,726,116 | A | 4/1973 | Dimotta | 70/378 X |
| 3,728,880 | A | 4/1973 | Falk | 70/382 X |
| 3,735,612 | A | 5/1973 | Popovici | 70/38 A |
| 3,754,422 | A | 8/1973 | Stackhouse | 70/377 X |
| 3,910,083 | A | 10/1975 | Burlingame | 70/383 |
| 3,990,282 | A | 11/1976 | Sorum | 70/377 X |
| 3,999,413 | A | 12/1976 | Raymond et al. | 70/377 X |
| 4,015,458 | A | 4/1977 | Mercurio | 70/377 X |
| 4,069,694 | A | 1/1978 | Raymond et al. | 70/337 |
| 4,094,175 | A | 6/1978 | Pechner | 70/383 X |
| 4,142,391 | A | 3/1979 | Paig | 70/461 |
| 4,320,639 | A | 3/1982 | Kleefeldt et al. | 70/337 X |
| 4,372,139 | A | 2/1983 | Laake | 70/383 |
| 4,376,382 | A | 3/1983 | Raymond et al. | 70/338 |
| 4,377,940 | A | 3/1983 | Hucknall | 70/378 X |
| 4,393,673 | A | 7/1983 | Widen | 70/358 |
| 4,404,824 | A | 9/1983 | Hennessy | 70/419 X |
| 4,412,437 | A | 11/1983 | Smith | 70/338 |
| 4,440,009 | A | 4/1984 | Smith | 70/385 |
| 4,689,978 | A | 9/1987 | Drummond | 70/431 |
| 4,712,399 | A | 12/1987 | Mattossovich | 70/495 |
| 4,712,401 | A | 12/1987 | Monahan | 70/382 |
| 4,712,402 | A | 12/1987 | Monahan | 70/383 |
| 4,729,231 | A | 3/1988 | Wu | 70/383 |
| 4,732,023 | A | 3/1988 | Shen | 70/383 |
| 4,741,188 | A | 5/1988 | Smith | 70/383 |
| 4,747,281 | A | 5/1988 | Monahan | 70/383 |
| 4,765,163 | A | 8/1988 | Trull et al. | 70/224 |
| 4,794,772 | A | 1/1989 | Falk et al. | 70/491 |
| 4,836,002 | A | 6/1989 | Monahan | 70/382 |
| 4,850,210 | A | 7/1989 | Adler et al. | 70/283 |
| 4,899,563 | A | 2/1990 | Martin | 70/367 |
| 4,909,053 | A | 3/1990 | Zipf, III et al. | 70/283 |
| 4,912,953 | A | 4/1990 | Wobig | 70/383 |
| 4,920,774 | A | 5/1990 | Martin | 70/367 |
| 4,942,749 | A | 7/1990 | Rabinow | 70/495 |
| 4,966,021 | A | 10/1990 | Boag | 70/383 |
| 4,996,856 | A | 3/1991 | Lin et al. | 70/359 |
| 5,010,753 | A | 4/1991 | Boris, Jr. | 70/371 |
| 5,024,071 | A | 6/1991 | Shafirkin | 70/387 |
| 5,038,589 | A | 8/1991 | Martin | 70/368 |
| 5,044,180 | A | 9/1991 | Lebrecht | 70/48 |
| 5,076,081 | A | 12/1991 | Boris, Jr. | 70/398 |
| 5,121,619 | A | 6/1992 | Martin | 70/371 |
| 5,174,136 | A | 12/1992 | Thwing | 70/38 A |
| 5,209,088 | A | 5/1993 | Vaks | 70/384 |
| 5,211,044 | A | 5/1993 | Kim | 70/371 |
| 5,233,850 | A | 8/1993 | Schroeder | 70/337 |
| 5,325,690 | A | 7/1994 | Adler et al. | 70/383 |
| 5,428,978 | A | 7/1995 | Tsukano | 70/386 |
| 5,431,034 | A | 7/1995 | Fann et al. | 70/369 |
| 5,540,071 | A | 7/1996 | Reikher | 70/495 |
| 5,640,865 | A | 6/1997 | Widen | 70/495 |
| 5,704,234 | A | 1/1998 | Resch | 70/371 |
| 5,718,136 | A | 2/1998 | Aldieri et al. | 70/385 |
| 5,752,400 | A | 5/1998 | Kim | 70/368 |
| 5,765,417 | A | 6/1998 | Bolton | 70/495 |
| 5,791,181 | A | 8/1998 | Sperber et al. | 70/383 |
| 5,884,512 | A | 3/1999 | Wayne | 70/370 |
| 5,921,122 | A | 7/1999 | Lin | 70/368 |
| 5,921,123 | A | 7/1999 | Schwarzkopf et al. | 70/371 |
| 5,970,760 | A | 10/1999 | Shen | 70/371 |
| 5,979,200 | A | 11/1999 | Cliff | 70/491 |
| 6,029,484 | A | 2/2000 | Jetton | 70/371 |
| 6,047,577 | A | 4/2000 | Klimas | 70/340 |
| 6,076,386 | A | 6/2000 | Etchells et al. | 70/369 |
| 6,079,240 | A | 6/2000 | Shvarts | 70/367 |
| 6,119,495 | A | 9/2000 | Loreti | 70/430 |
| 6,134,928 | A | 10/2000 | Kang | 70/394 |
| 6,142,717 | A | 11/2000 | Staiger | 408/115 R |
| 6,295,850 | B1 | 10/2001 | Anderson | 70/492 |
| 6,425,274 | B1 | 7/2002 | Laitala et al. | 70/394 |
| 6,516,643 | B1 | 2/2003 | Olshausen | 70/337 |
| 6,523,378 | B1 | 2/2003 | Kuo | 70/360 |
| 6,532,782 | B1 | 3/2003 | Chiu | 70/369 |
| 6,564,601 | B1 | 5/2003 | Hyatt, Jr. | 70/278.3 |
| 6,776,017 | B1 | 8/2004 | Herdman | 70/338 |
| 6,860,131 | B1 * | 3/2005 | Armstrong et al. | 70/492 |
| 6,862,909 | B1 * | 3/2005 | Armstrong et al. | 70/492 |
| 6,871,520 | B1 * | 3/2005 | Armstrong et al. | 70/492 |
| 2003/0037582 | A1 | 2/2003 | Edwards, Jr. et al. | 70/495 |
| 2003/0084692 | A1 | 5/2003 | Herdman | 70/338 |
| 2003/0089149 | A1 | 5/2003 | Suzuki et al. | 70/492 |
| 2003/0154753 | A1 | 8/2003 | Dimig et al. | 70/495 |
| 2004/0069030 | A1 | 4/2004 | Takadama | 70/495 |

FOREIGN PATENT DOCUMENTS

| | | |
|---|---|---|
| EP | 0210037 | 1/1987 |
| EP | 0872615 | 10/1998 |
| WO | WO9314290 | 7/1993 |
| WO | WO9736072 | 10/1997 |

* cited by examiner

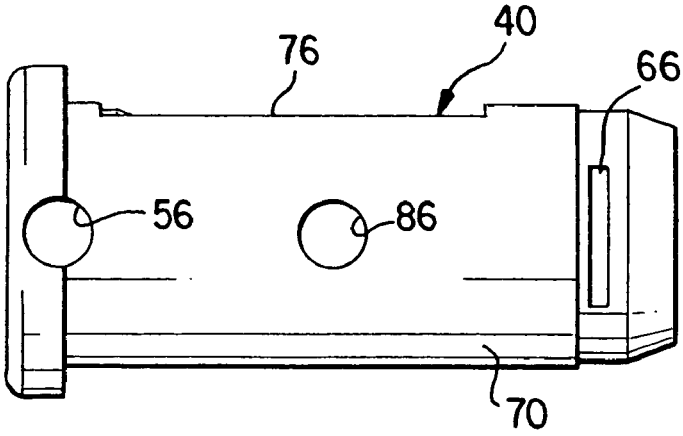
FIG. 16D
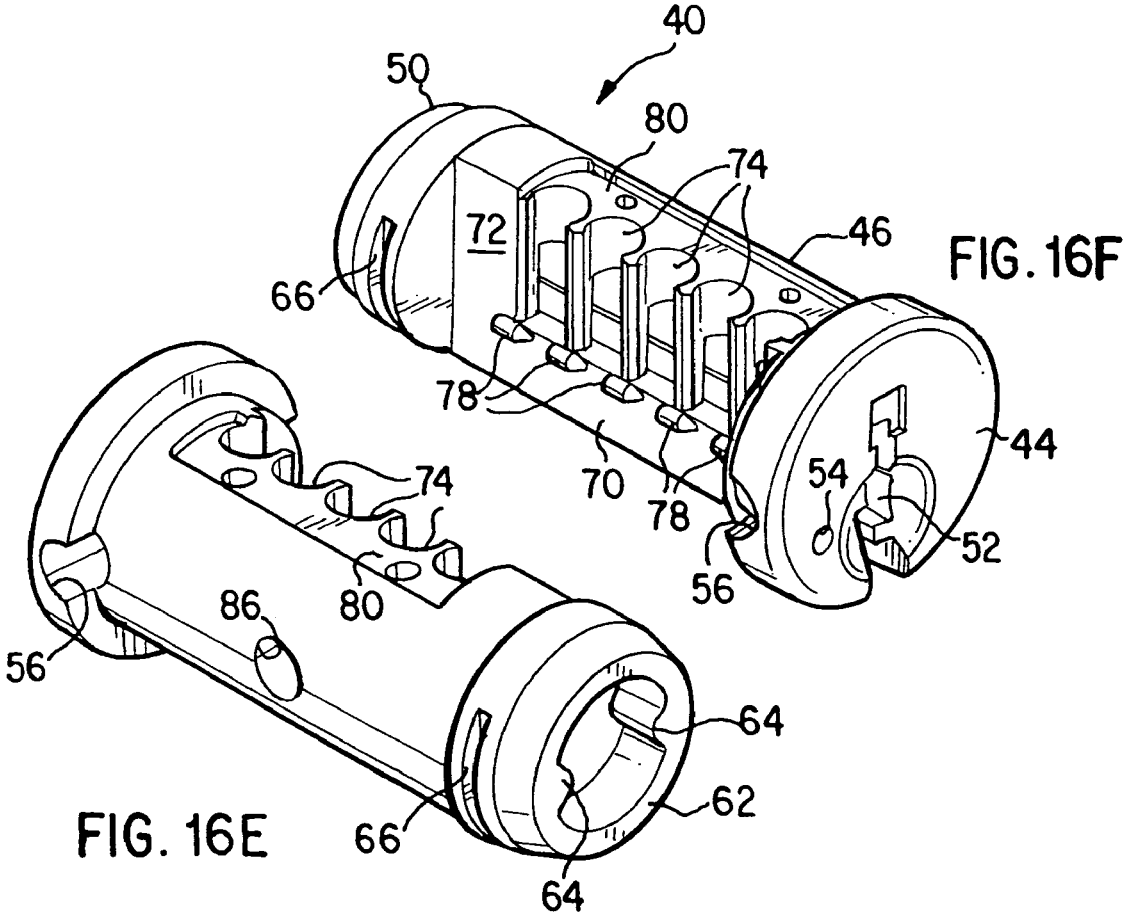
FIG. 16F
FIG. 16E

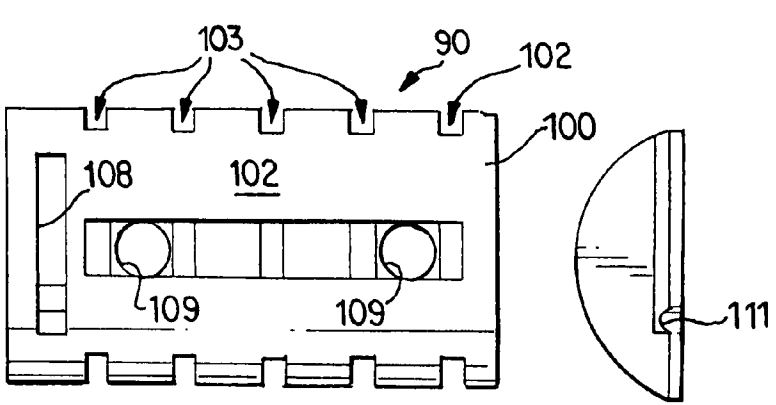
FIG.17A
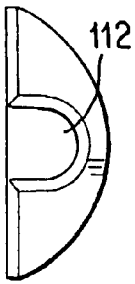
FIG.17B
FIG.17C
FIG.17D
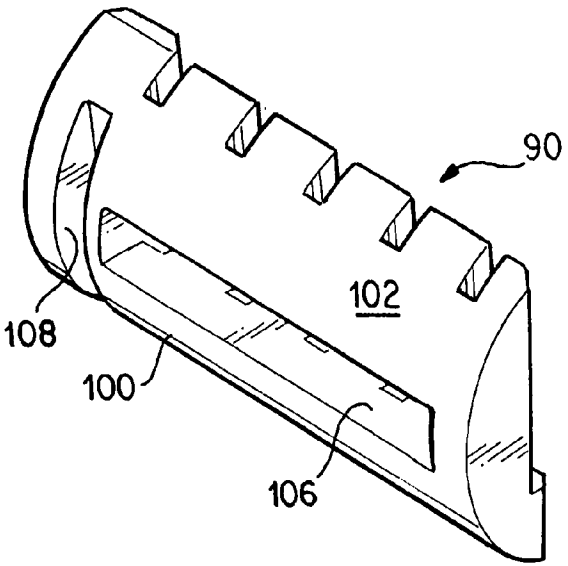
FIG.17E
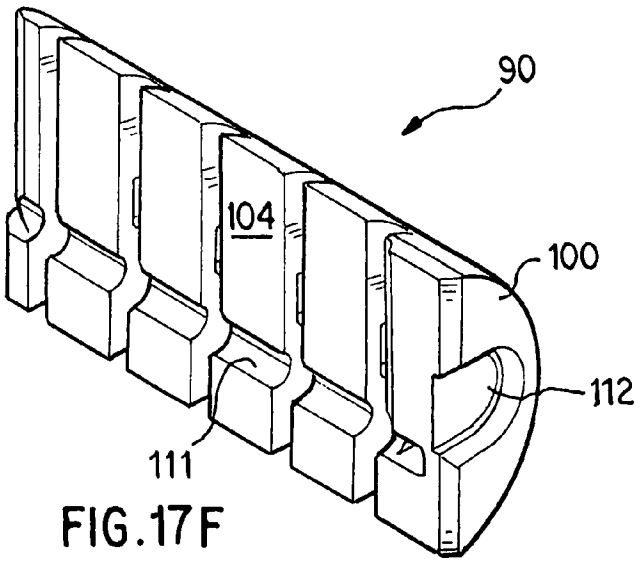
FIG.17F

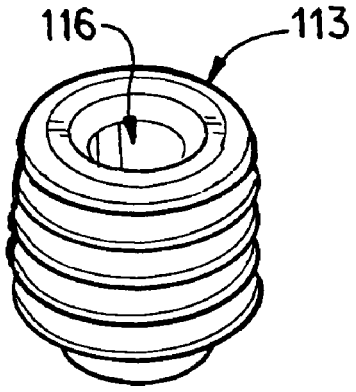
FIG. 20A
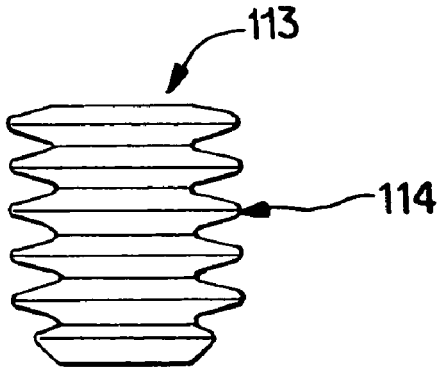
FIG. 20B
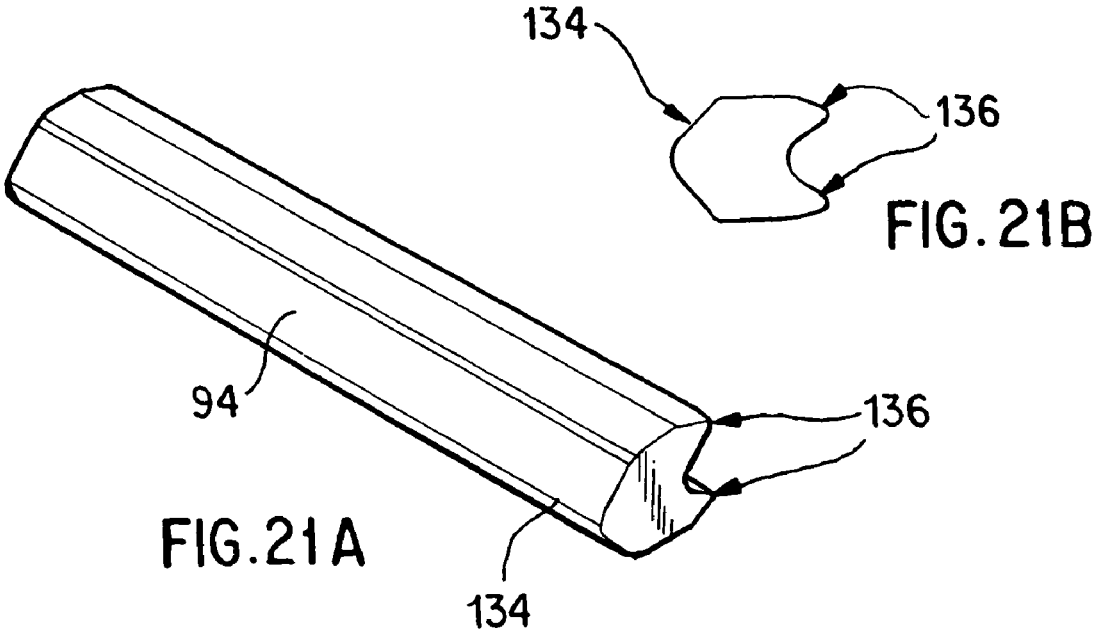
FIG. 21B
FIG. 21A

DEVICES, METHODS, AND SYSTEMS FOR KEYING A LOCK ASSEMBLY

CROSS-REFERENCE TO RELATED APPLICATIONS

This application is a Divisional of application Ser. No. 10/384,294, filed Mar. 7, 2003, now U.S. Pat. No. 6,862,909, which is a Continuation-in-Part of application Ser. No. 10/256,066, filed 26 Sep. 2002, now U.S. Pat. No. 6,860,131.

BRIEF DESCRIPTION OF THE DRAWINGS

The invention and its wide variety of potential embodiments will be readily understood via the following detailed description of certain exemplary embodiments, with reference to the accompanying drawings in which:

FIGS. 16*a*–16*f* are various views of the cylinder plug body for use in the present invention.

FIGS. 17*a*–17*f* are various view of the carrier for use in the present invention.

FIGS. 20*a*–20*b* are views of a pin for use in the present invention.

FIGS. 21*a*-21*b* are views of a locking bar for use in the present invention.

DETAILED DESCRIPTION

Figure 1:
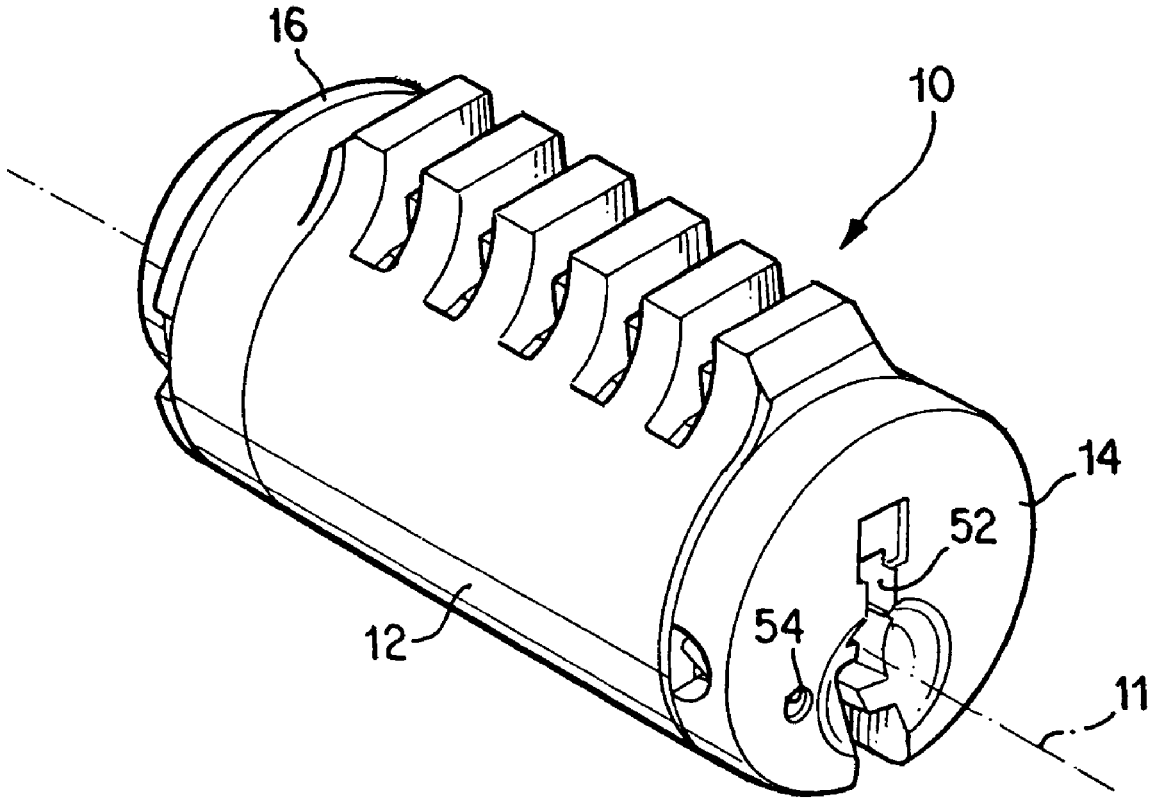
FIG. 1 illustrates a lock cylinder according to the present invention.

When rekeying a lock assembly having a traditional cylinder design, the user is required to remove the cylinder plug from the cylinder body and replace the appropriate pins so that a new key can be used to unlock the cylinder. This typically requires the user to remove the cylinder mechanism from the lockset and then disassemble the cylinder to some degree to remove the plug and replace the pins. This requires a working knowledge of the lockset and cylinder mechanism and is usually only performed by locksmiths or trained professionals. Additionally, the process usually employs special tools and requires the user to have access to pinning kits to interchange pins and replace components that can get lost or damaged in the rekeying process. Finally, professionals using appropriate tools can easily pick traditional cylinders.

Certain exemplary embodiments of the present invention provide a rekeying system comprising: a rekeyable lock cylinder comprising: a cylinder body; a plug assembly disposed in said cylinder body and comprising a plurality of pins and a one-to-one corresponding plurality of racks for relocating said plurality of pins; and a rekeying tool receiving aperture defined by said rekeyable lock cylinder; and a rekeying tool comprising: a base plate; and a plurality of spaced elongated prongs, each prong from said plurality of prongs comprising a first longitudinal end adapted to engage a corresponding one of said plurality of racks, each prong from said plurality of prongs dimensioned lengthwise to relocate to a first predetermined position said corresponding one of said plurality of racks, said first predetermined position common to each of said plurality of racks, each prong from said plurality of prongs comprising a second longitudinal end connected to said base plate.

Certain exemplary embodiments of the present invention provide a rekeying tool for a rekeyable lock cylinder comprising a cylinder body and a plug assembly disposed in the cylinder body and comprising a plurality of pins and a one-to-one corresponding plurality of racks for relocating the pins, said lock cylinder defining a tool-receiving aperture, said rekeying tool comprising: a base plate defining a first face and a second face, said first face opposing said second face; a plurality of spaced elongated prongs, each prong from said plurality of prongs comprising a concave first longitudinal end adapted to engage a corresponding one of the plurality of racks, each prong from said plurality of prongs dimensioned lengthwise to relocate to a first predetermined position the corresponding one of the plurality of racks, the first predetermined position common to each of the plurality of racks, each prong from said plurality of prongs comprising a second longitudinal end connected to said base plate; and a handle connected to said second face of said base plate.

Certain exemplary embodiments of the present invention provide a method for rekeying a rekeyable lock cylinder comprising a cylinder body, and a plug assembly disposed in said cylinder body and comprising a plurality of pins and a one-to-one corresponding plurality of racks for relocating said pins, said lock cylinder defining a tool-receiving aperture, comprising the activities of: inserting a rekeying tool into the tool-receiving aperture, relocating the plurality of racks to a first predetermined level; rotating the plug assembly with respect to the cylinder body from a first position to a second position; and disengaging the plurality of racks from the plurality of pins.

Certain exemplary embodiments of the present invention provide a lock keying system comprising: a lock cylinder comprising: a cylinder body; a plug assembly disposed in said cylinder body and comprising a plurality of pins and a one-to-one corresponding plurality of racks for relocating said plurality of pins; and a rack alignment tool receiving aperture defined by said lock cylinder; and a rack alignment tool comprising: a base plate; and a plurality of spaced elongated prongs, each prong from said plurality of prongs comprising a first longitudinal end adapted to engage a corresponding one of said plurality of racks, each prong from said plurality of prongs dimensioned lengthwise to relocate to a first predetermined position said corresponding one of said plurality of racks, said first predetermined position common to each of said plurality of racks, each prong from said plurality of prongs comprising a second longitudinal end connected to said base plate, wherein said rack alignment tool is adapted to restrain a carrier assembly comprising said plurality of racks in an unengaged position wherein said plurality of racks are unengaged with said plurality of pins.

Certain exemplary embodiments of the present invention provide a lock keying tool for a lock cylinder comprising a cylinder body and a plug assembly disposed in the cylinder body and comprising a plurality of pins and a one-to-one corresponding plurality of racks for relocating the pins, said lock cylinder defining a tool-receiving aperture, said lock keying tool comprising: a base plate defining a first face and a second face, said first face opposing said second face; a plurality of spaced elongated prongs, each prong from said plurality of prongs comprising a concave first longitudinal end disposed on a first portion of said prong and adapted to engage a corresponding one of the plurality of racks, each prong from said plurality of prongs defining a longitudinal axis and longitudinally dimensioned to relocate to a first predetermined position the corresponding one of the plurality of racks, the first predetermined position common to each of the plurality of racks, each prong from said plurality of prongs comprising a second longitudinal end disposed on a second portion of said prong and connected to said base plate, said second portion having a wider axial cross-section than said first portion; and a handle connected to said second face of said base plate.

Certain exemplary embodiments of the present invention provide a method for keying a lock cylinder comprising a cylinder body and a plug assembly disposed in said cylinder body, said plug assembly comprising a plurality of pins and a one-to-one corresponding plurality of racks for relocating said pins, said lock cylinder defining a tool-receiving aperture, comprising the activities of: while the plurality of racks are not engaged with the plurality of pins: aligning the plurality of racks to a first predetermined level; and after aligning the plurality of racks to the first predetermined level, inserting a key into the plug assembly, the plurality of pins relocated by the key; and after inserting the key into the plug assembly, engaging the plurality of racks with the plurality of pins.

Figure 2:
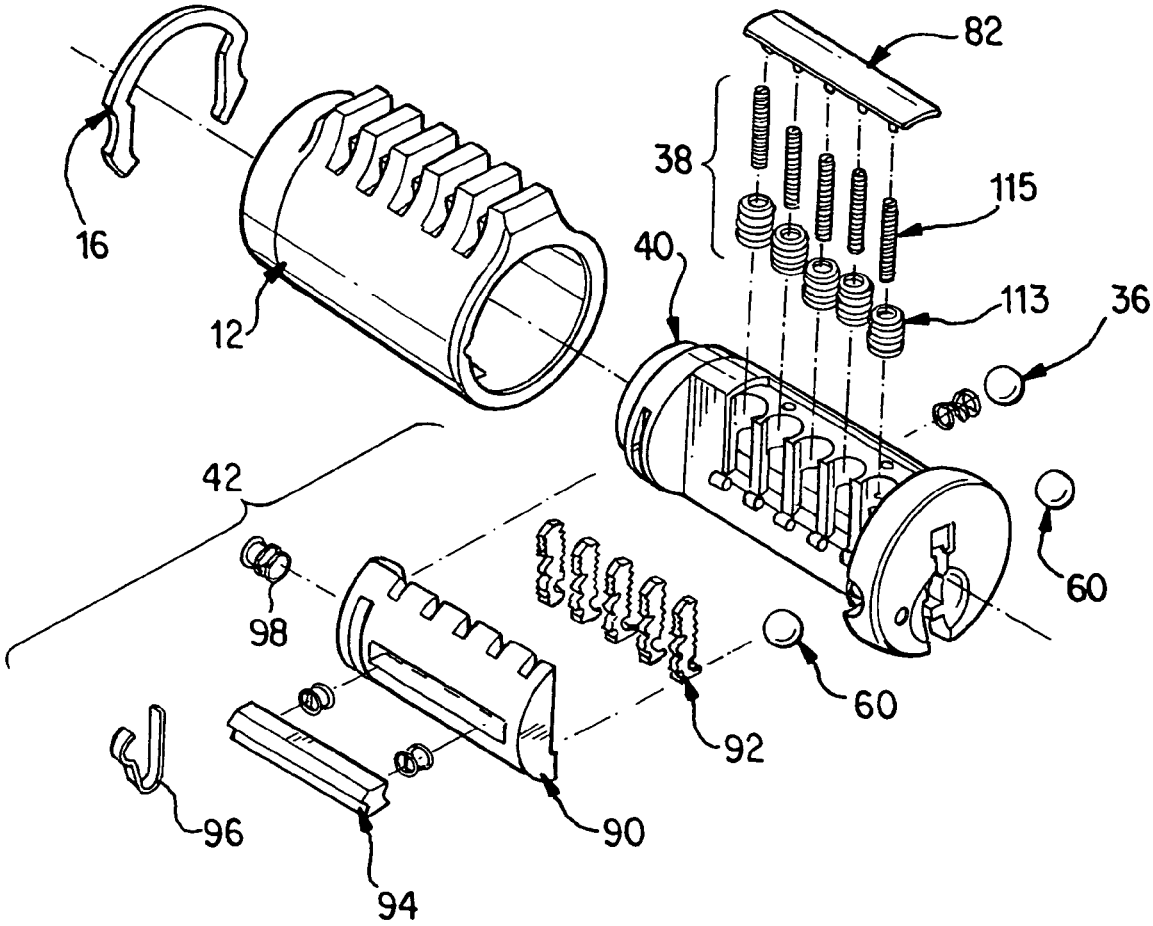
FIG. 2 is an exploded view of the lock cylinder of FIG. 1.

A lock cylinder 10 according to an exemplary embodiment of the present invention is illustrated in FIGS. 1–2. The lock cylinder 10 includes a longitudinal axis 11, a lock cylinder body 12, a plug assembly 14 and a retainer 16. In FIG. 1, the plug assembly 14 is in the home position relative to the cylinder body 12.

The lock cylinder body 12, as seen in FIGS. 15*a*–15*e*, includes a generally cylindrical body 20 having a front end 22, a back end 24 and a cylinder wall 26 defining an interior surface 28. The cylinder wall 26 includes an interior, locking bar-engaging groove 29 and a pair of detent recesses 30, 32. The generally V-shaped locking bar-engaging groove 29 extends longitudinally along a portion of the cylinder body 12 from the front end 22. The first detent recess 30 is disposed at the back end 24 and extends to a first depth. The second detent recess 32 is disposed adjacent the first detent recess 30 and extends to a lesser depth. A detent bore 34 extends radially through the cylinder wall 26 for receiving a detent ball 36 (FIG. 2).

The plug assembly 14 includes a plug body 40, a carrier sub-assembly 42 and a plurality of spring-loaded pins 38 (FIGS. 2 and 20*a*–20*b*). The plug body 40, illustrated in FIGS. 16*a*–16*f*, includes a plug face 44, an intermediate portion 46 and a drive portion 50. The plug face 44 defines a keyway opening 52, a rekeying tool opening 54 and a pair of channels 56 extending radially outwardly for receiving anti-drilling ball bearings 60 (FIG. 2). The drive portion 50 includes an annular wall 62 with a pair of opposed projections 64 extending radially inwardly to drive a spindle or torque blade (neither shown). The drive portion 50 further includes a pair of slots 66 formed in its perimeter for receiving the retainer 16 to retain the plug body 40 in the cylinder body 12.

The intermediate portion 46 includes a main portion 70 formed as a cylinder section and having a first longitudinal planar surface 72 and a plurality of channels 74 for receiving the spring-loaded pins 38. The channels 74 extend transversely to the longitudinal axis of the plug body 40 and parallel to the planar surface 72. A second planar surface 76 extends perpendicular to the first planar surface 72 and defines a recess 80 for receiving a retaining cap 82 (FIGS. 2 and 22*a*–22*d*). The channels 74 extend from the second planar surface 76 partially through the plug body 40, with the sidewalls of the channels open to the first planar surface 72. The first planar surface 72 further includes a plurality of bullet-shaped, rack-engaging features 78. A bore 86 for receiving a spring-loaded detent ball 36 (FIG. 2) extends radially inwardly from opposite the first planar surface 72.

Figure 6:
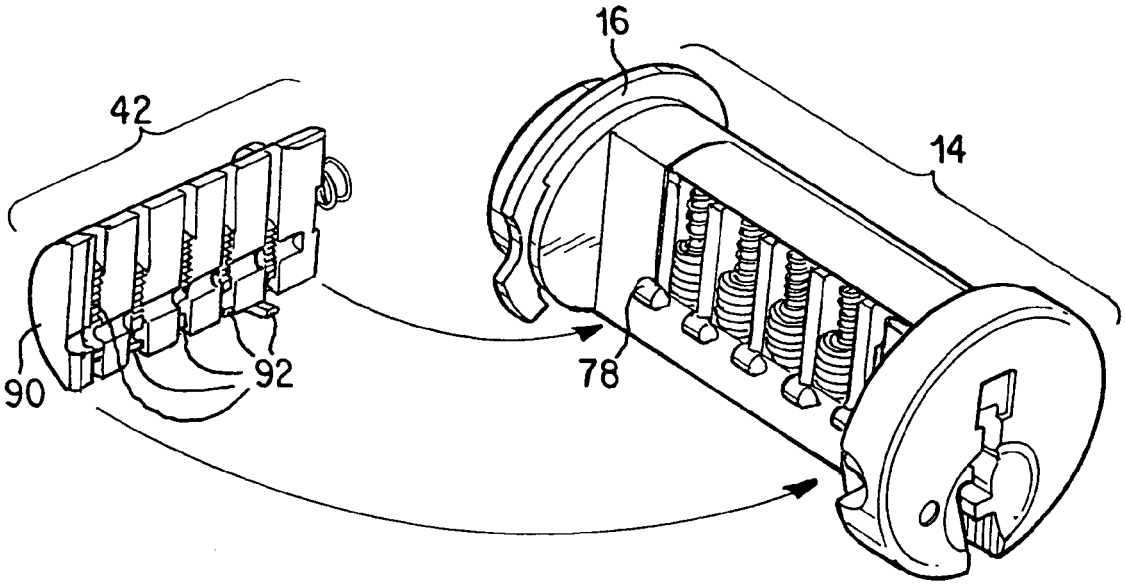
FIG. 6 is a partially exploded view of the plug assembly of FIG. 3.
Figure 10:
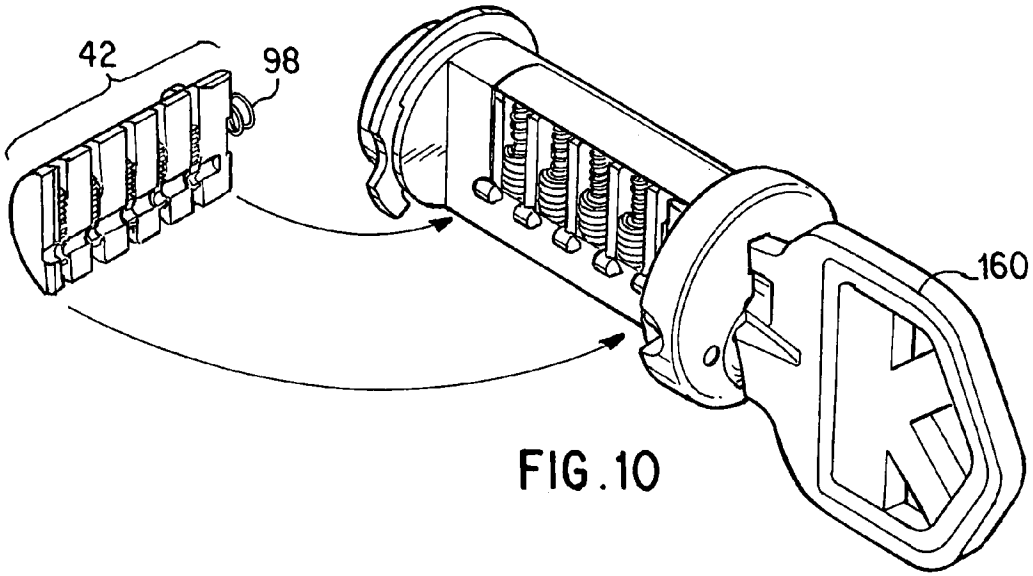
FIG. 10 is a partially broken away side view of the plug assembly of FIG. 8.
Figure 11:
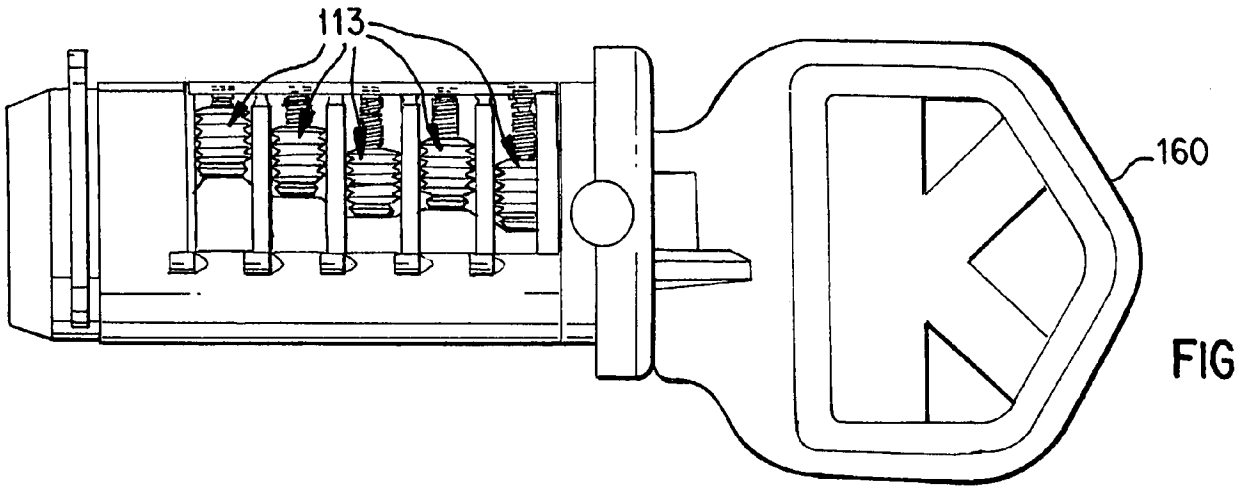
FIG. 11 is a partially exploded view of the plug assembly of FIG. 8.
Figure 18A:
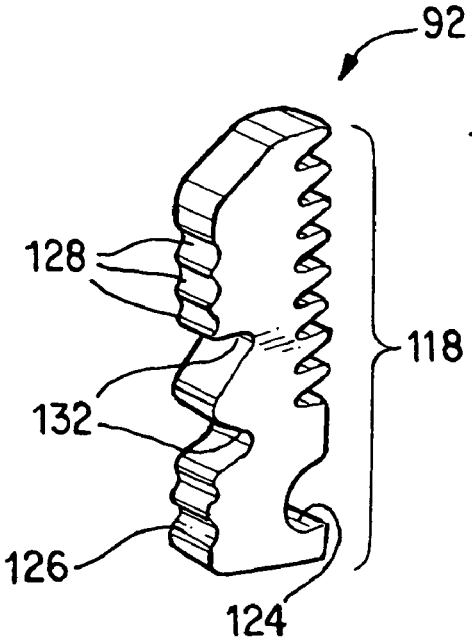
FIGS. 18*a*–18*b* are views of a rack for use in the present invention.
Figure 18B:
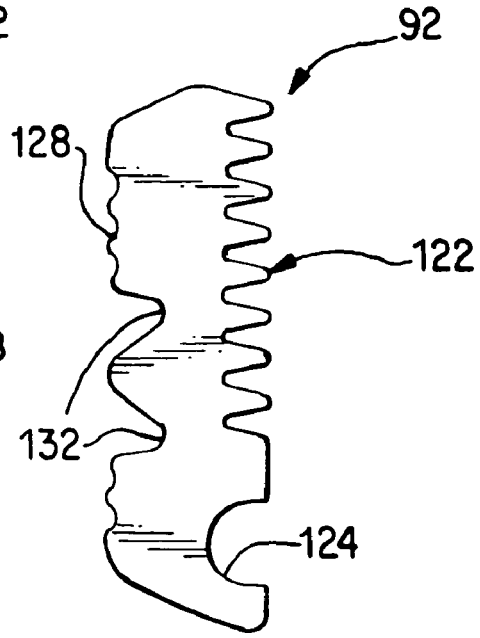
Figure 19A:
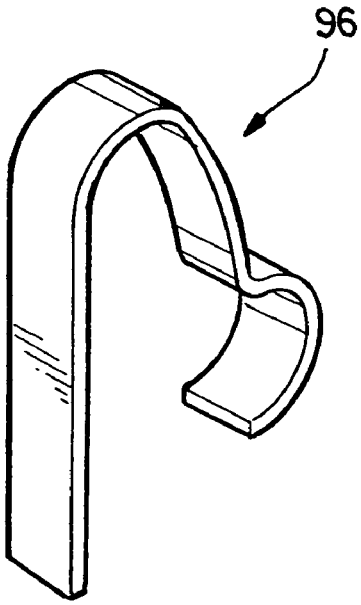
FIGS. 19*a*–19*b* are views of a spring catch for use in the present invention.
Figure 19B:
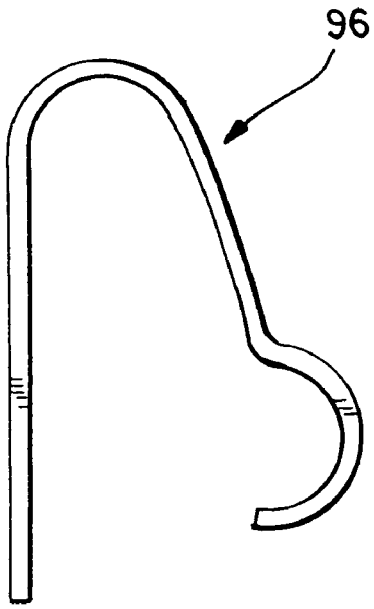
Figure 22A:
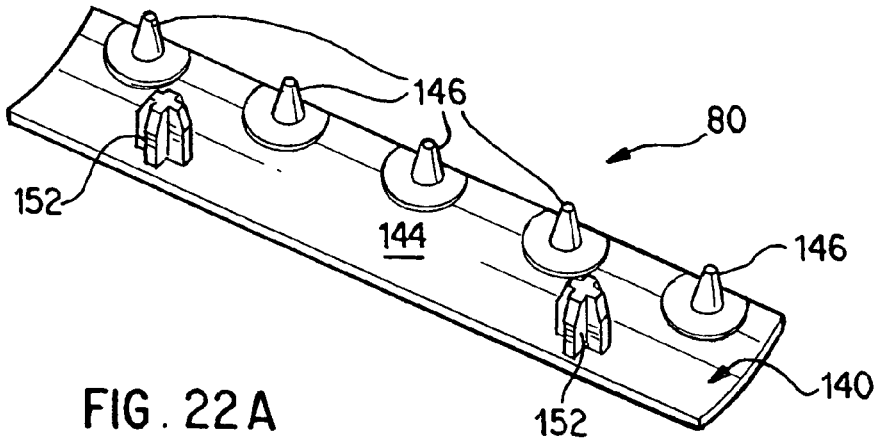
FIGS. 22*a*–22*d* are views of a spring retaining cap for use in the present invention.
Figure 22B:
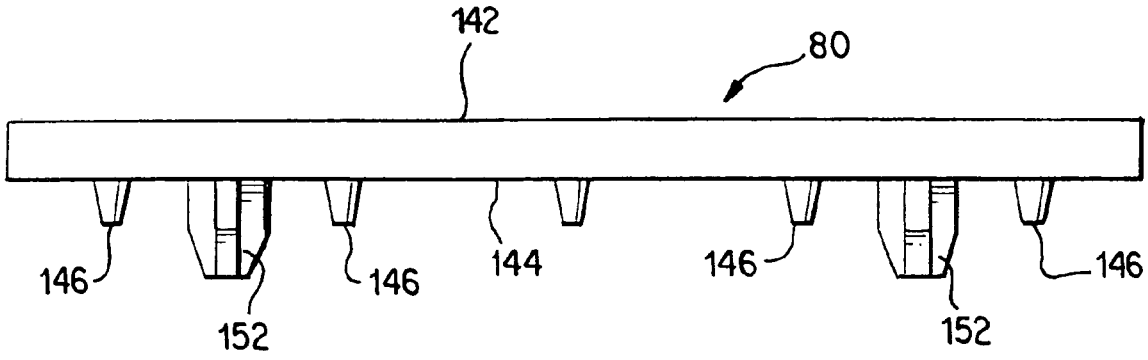
Figure 22C:
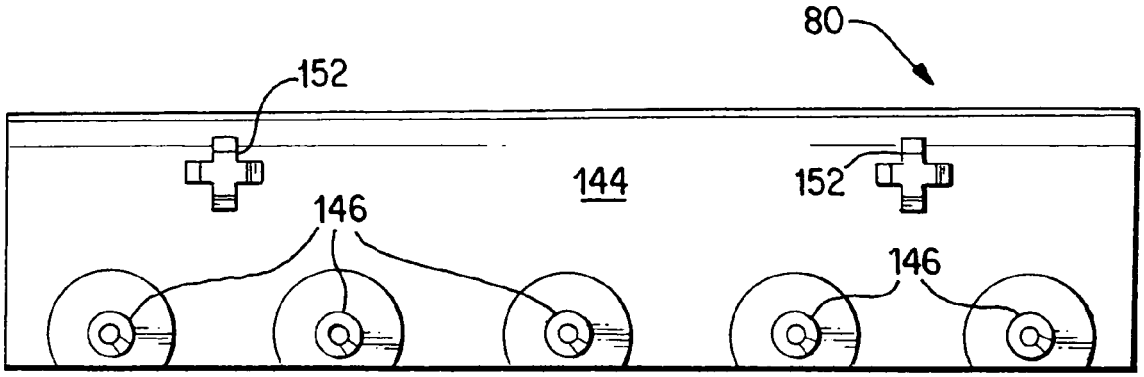
Figure 22D:
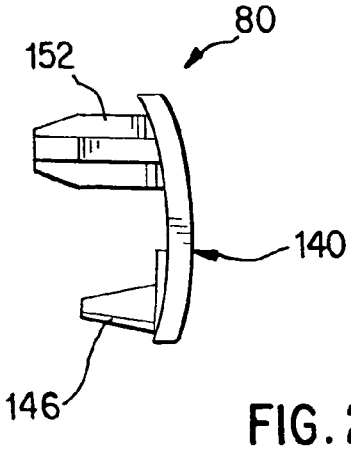

The carrier sub-assembly 42 (FIGS. 2, 6 and 10) includes a carrier 90 (FIGS. 17*a*–17*e*), a plurality of racks 92 (FIGS. 18*a*–18*b*), a spring catch 96 (FIGS. 19*a*–19*b*), a spring-loaded locking bar 94 (FIGS. 21*a*–21*b*), and a return spring 98 (FIG. 2). The carrier 90 includes a body 100 in the form of a cylinder section that is complementary to the main portion 70 of the plug body 40, such that the carrier 90 and the main portion 70 combine to form a cylinder that fits inside the lock cylinder body 12. The carrier 90 includes a curved surface 102 and a flat surface 104. The curved surface 102 includes a locking bar recess 106 and a spring catch recess 108. The locking bar recess 106 further includes a pair of return spring-receiving bores 109 (FIG. 17*c*) for receiving the locking bar return springs. The flat surface 104 includes a plurality of parallel rack-receiving slots 103 extending perpendicular to the longitudinal axis of the carrier. A semi-circular groove 111 extends along the flat surface 104 parallel to the longitudinal axis of the carrier 90. The back end of the carrier 90 includes a recess 112 for receiving the return spring 98.

Figure 7:
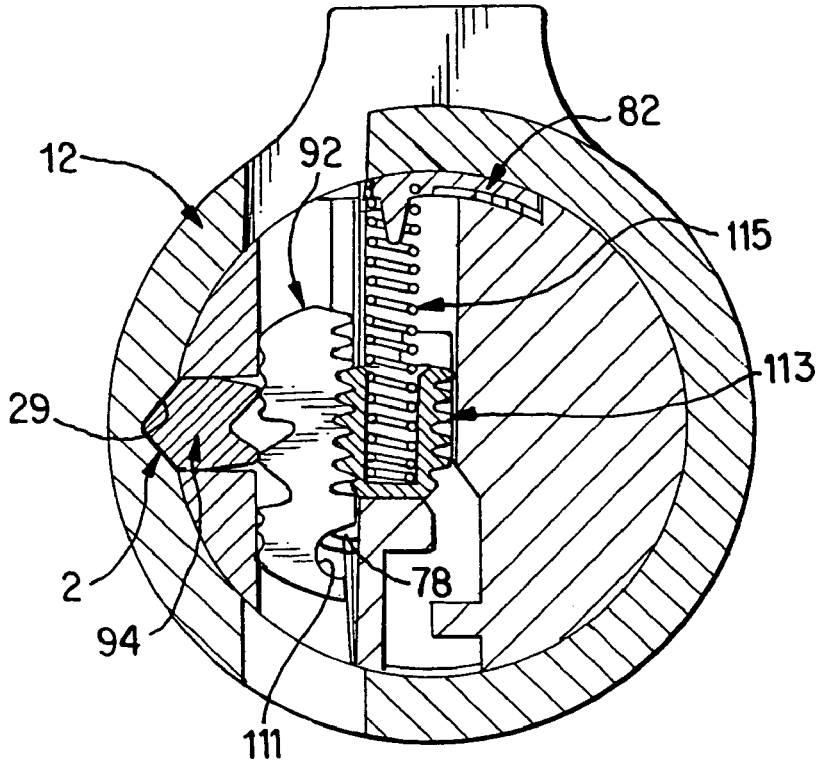
FIG. 7 is a section view through the plug assembly of FIG. 3 and a cylinder body, the section being taken transversely at one of the pins and illustrating the positioning of the pin, a rack, and the locking bar relative to each other and the cylinder body in a locked configuration.
Figure 12:
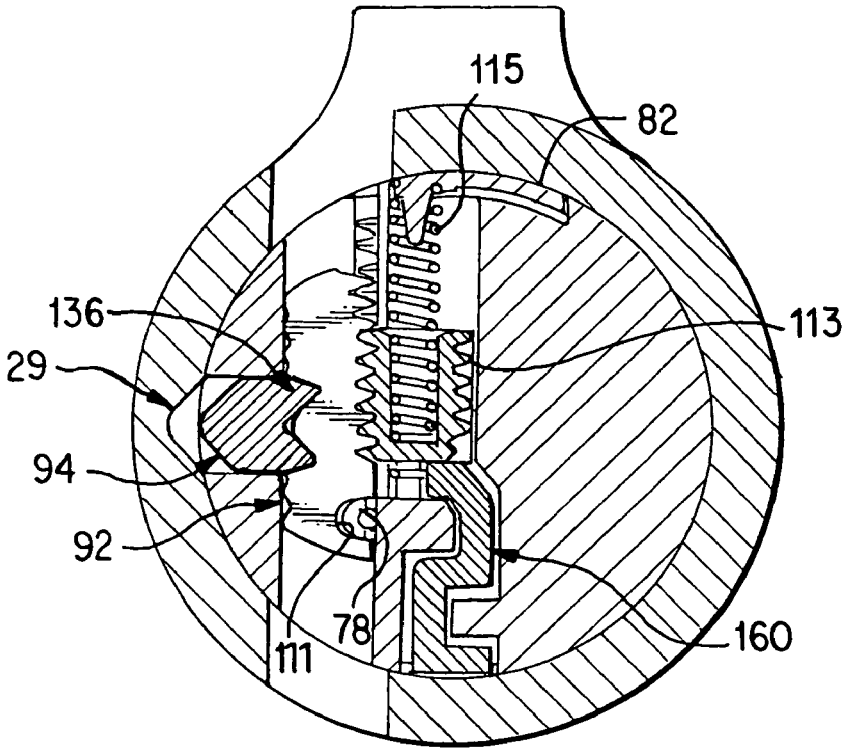
FIG. 12 is a section view through the plug assembly of FIG. 8 and a cylinder body, the section being taken transversely at one of the pins and illustrating the positioning of the pin, the rack, and the locking bar relative to each other and the cylinder body in an unlocked configuration.

Each spring-loaded pin 38 includes a pin 113 and a biasing spring 115. The pins 113, illustrated in FIGS. 20*a*–20*b*, are generally cylindrical with annular gear teeth 114 and a central longitudinal bore 116 for receiving biasing springs 115 (FIG. 2). The racks 92, illustrated in FIGS. 18*a*–18*b*, include a pin-engaging surface 118 having a plurality of gear teeth 122 configured to engage the annular gear teeth 114 on the pins 113, as illustrated in FIGS. 7 and 12, and a semi-circular recess 124 for engaging the bullet-shaped, rack-engaging features 78 on the planar surface 72, as illustrated in FIG. 12. The racks 92 further include a second surface 126 that includes a plurality of anti-pick grooves 128 and a pair of locking bar-engaging grooves 132.

The spring-loaded locking bar 94, illustrated in FIGS. 21*a*–22*b*, is sized and configured to fit in the locking bar recess 106 in the carrier 90 and includes a triangular edge 134 configured to fit in the V-shaped locking bar-engaging groove 29. Opposite the triangular edge 134, the locking bar 94 includes a pair of longitudinally extending gear teeth 136 configured to engage the locking bar-engaging grooves 132 formed in the racks 92, as illustrated in FIG. 12.

The spring-retaining cap 82, illustrated in FIGS. 22*a*–22*d*, includes a curvilinear portion 140 having an upper surface 142 and a lower surface 144. The thickness of the curvilinear portion 140 is set to allow the curvilinear portion 140 to fit in the recess 80 with the upper surface 142 flush with the intermediate portion 46 of the plug body 40, as illustrated in FIGS. 7 and 12. A plurality of spring alignment tips 146 extend from the lower surface 144 to engage the springs 115. In addition, a pair of cap retaining tips 152 extend from the lower surface 144 to engage alignment openings 454 formed in the plug body 40 (FIGS. 16*e*–16*f*).

Figure 3:
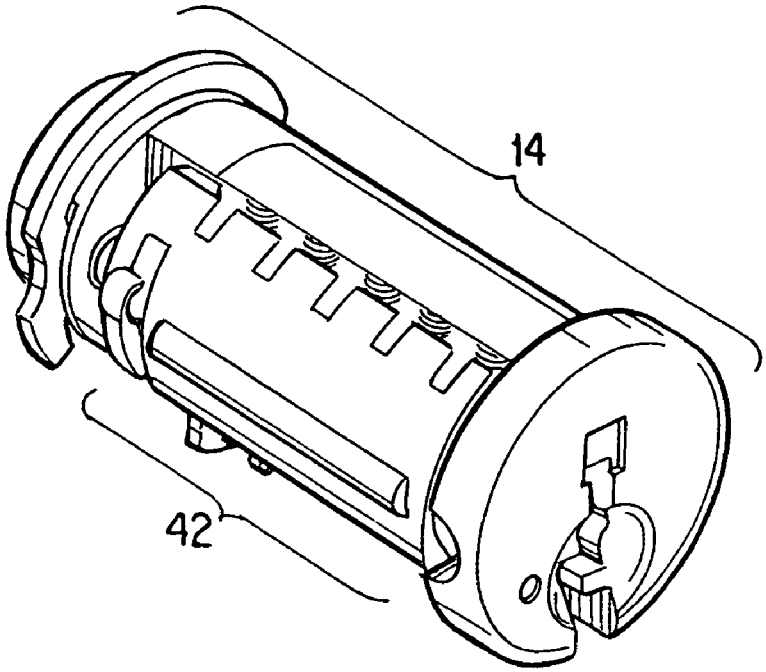
FIG. 3 is a perspective view of a plug assembly illustrating a carrier sub-assembly with a locking bar disposed in a locking position to lock the plug assembly in a lock cylinder body.

To assemble the lock cylinder 10, the pins 113 and spring 115 are disposed in the channels 74 of the plug body 40. The spring-retaining cap 82 is placed in the recess 80, with the cap retaining tips 152 disposed in the alignment openings 154 and the spring alignment tips 146 engaged with the springs 115. The carrier sub-assembly 42 is assembled by placing the racks 92 into the slots 103 and the spring-loaded locking bar 94 into the locking bar recess 106, with the gear teeth 136 engaging the locking bar-engaging grooves 132 formed in the racks 92. The spring catch 96 is disposed in the spring catch recess 108 of the carrier 90. A valid key 160 is inserted into the keyway 52, the return spring 98 is compressed into the return spring recess 112, and the carrier sub-assembly is placed adjacent the plug body 40, as illustrated in FIG. 3. The plug assembly 14 is placed in the lock cylinder body 12 and the retainer 16 is disposed in the slots 66 formed in the plug body 40 to retain the plug assembly 14 in the cylinder body 12. The lock cylinder 10 is now keyed to the valid key 160.

Figure 4:
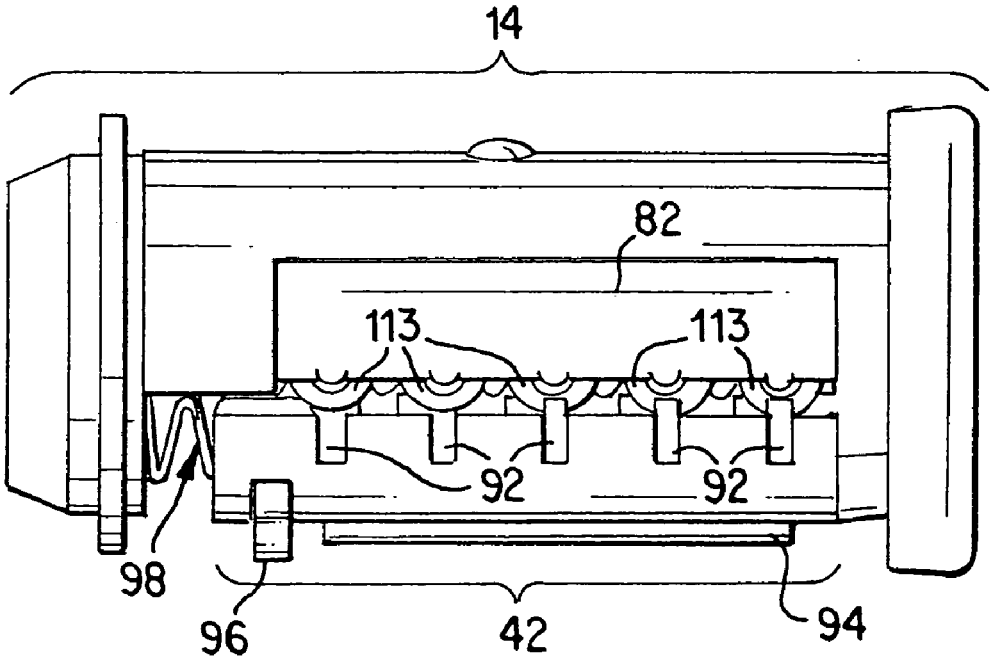
FIG. 4 is a top plan view of the plug assembly of FIG. 3.
Figure 5:
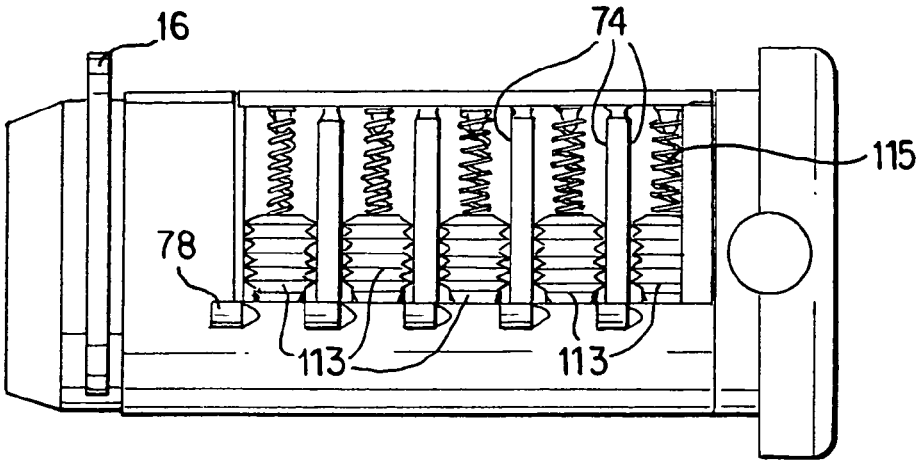
FIG. 5 is a partially broken away side view of the plug assembly of FIG. 3.

The properly keyed lock cylinder 10, without the key 160 inserted, is illustrated in FIGS. 4–7. The pins 113 are biased to the bottom of the channels 74 and, based on the cut of the key 160, the racks 92 are disposed at various positions in the slots 103 of the carrier 90. In this configuration, the locking bar 94 extends from the carrier 90 to engage the groove 29 in the cylinder body 12 to prevent the plug assembly 14 from rotating in the cylinder body 12 and the racks 92 engage the pins 113, as illustrated in FIG. 4. In addition, the bullet-shaped features 78 are misaligned with the recesses 111 in the racks 92 and therefore interfere with movement of the racks 92 parallel to the longitudinal axis of the lock cylinder 10, preventing the lock cylinder 10 from being rekeyed.

Figure 8:
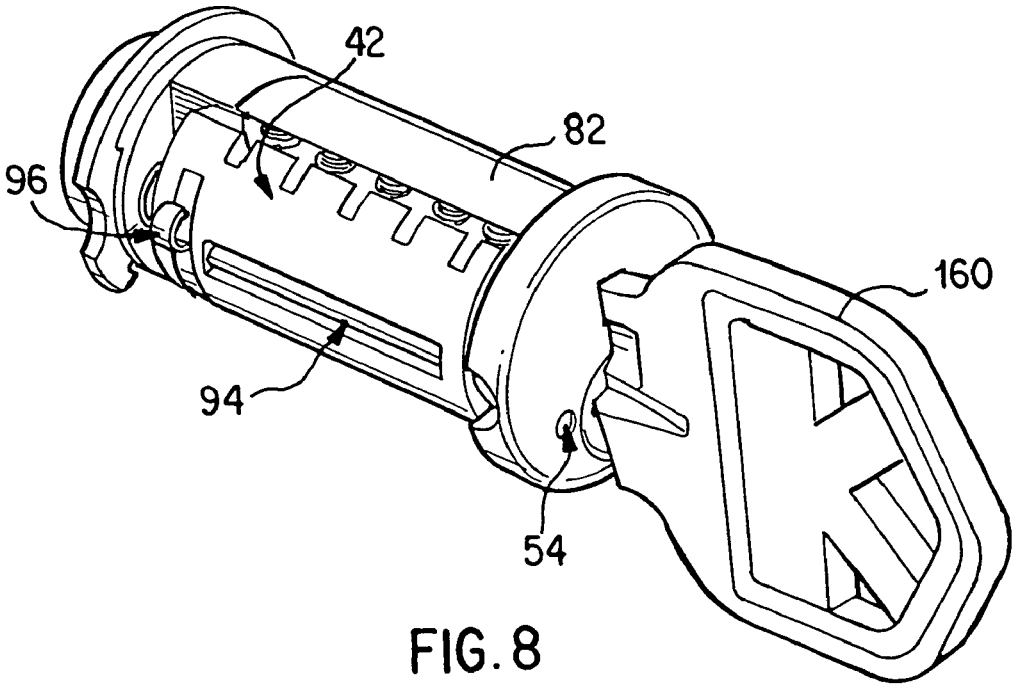
FIG. 8 is a perspective view of the plug assembly of FIG. 3 with a valid key inserted therein and illustrating the locking bar disposed in an unlocking position to allow the plug assembly to rotate in the lock cylinder body.
Figure 9:
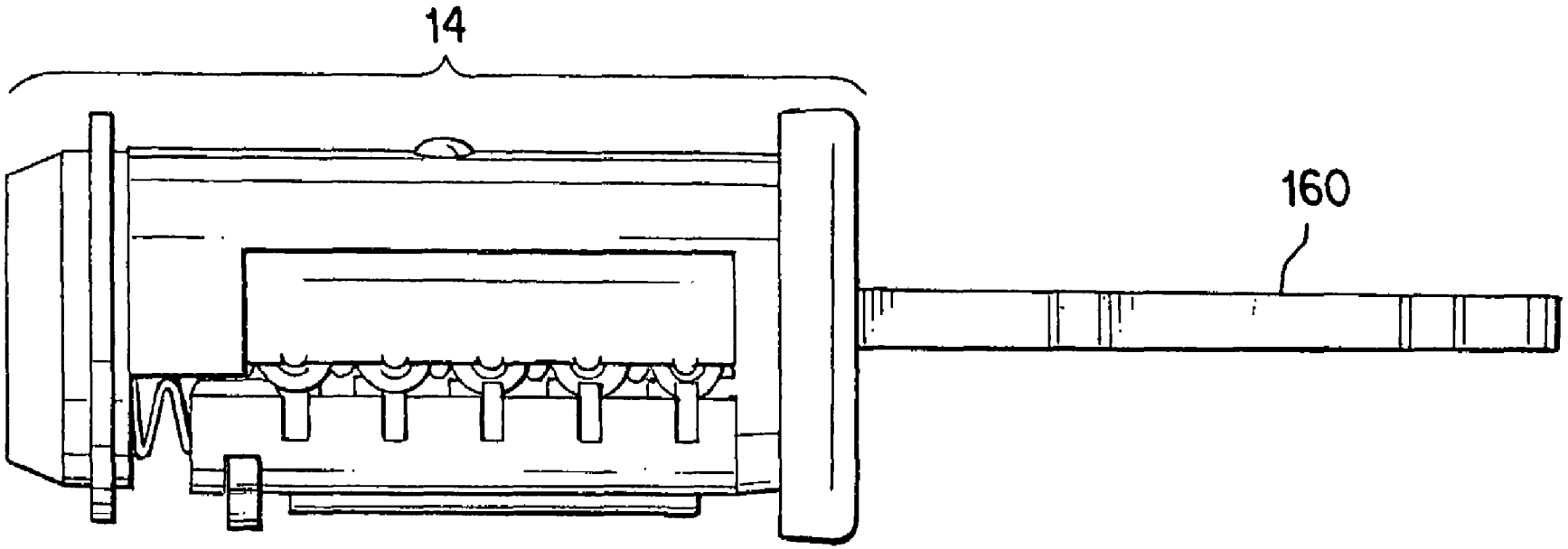
FIG. 9 is a top plan view of the plug assembly of FIG. 8.

The internal configuration of a lock cylinder 10 with the valid key 160 inserted therein at the home position is illustrated in FIGS. 8–12. In this configuration, the locking bar 94 is free to cam out of the groove 29 in the cylinder body 12, as depicted in FIGS. 8, 9 and 12. The bits of the key 160 lift the pins 113 in the channels 74 and thereby reposition the racks 92 in the slots 103. When repositioned, the racks 92 are disposed to align the locking bar-engaging grooves 132 with the extended gear teeth 136 on the locking bar 94. The locking bar 94 is free to cam out of the groove 29 as the key 160 is rotated. At the same time, the bullet-shaped features 78 are aligned with the recesses 111 in the racks 92, as illustrated in FIG. 12, allowing the racks 92, and the carrier 90, to move parallel to the longitudinal axis of the lock cylinder 10.

Figure 13:
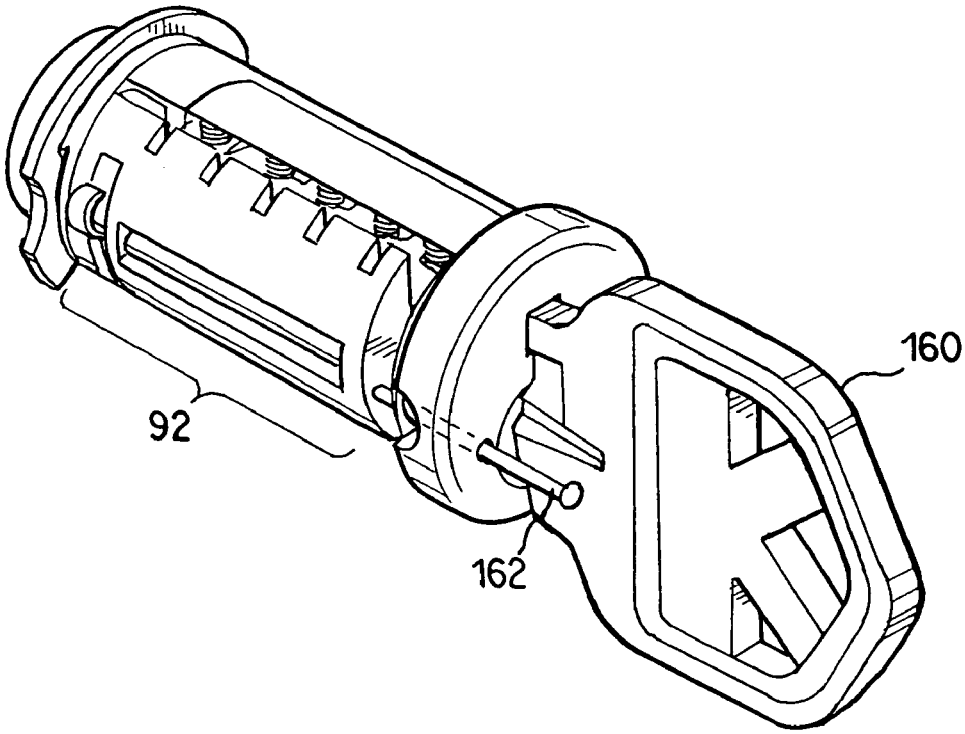
FIG. 13 is a perspective view similar to FIG. 8 but with the carrier assembly moved axially to a rekeying position.
Figure 14:
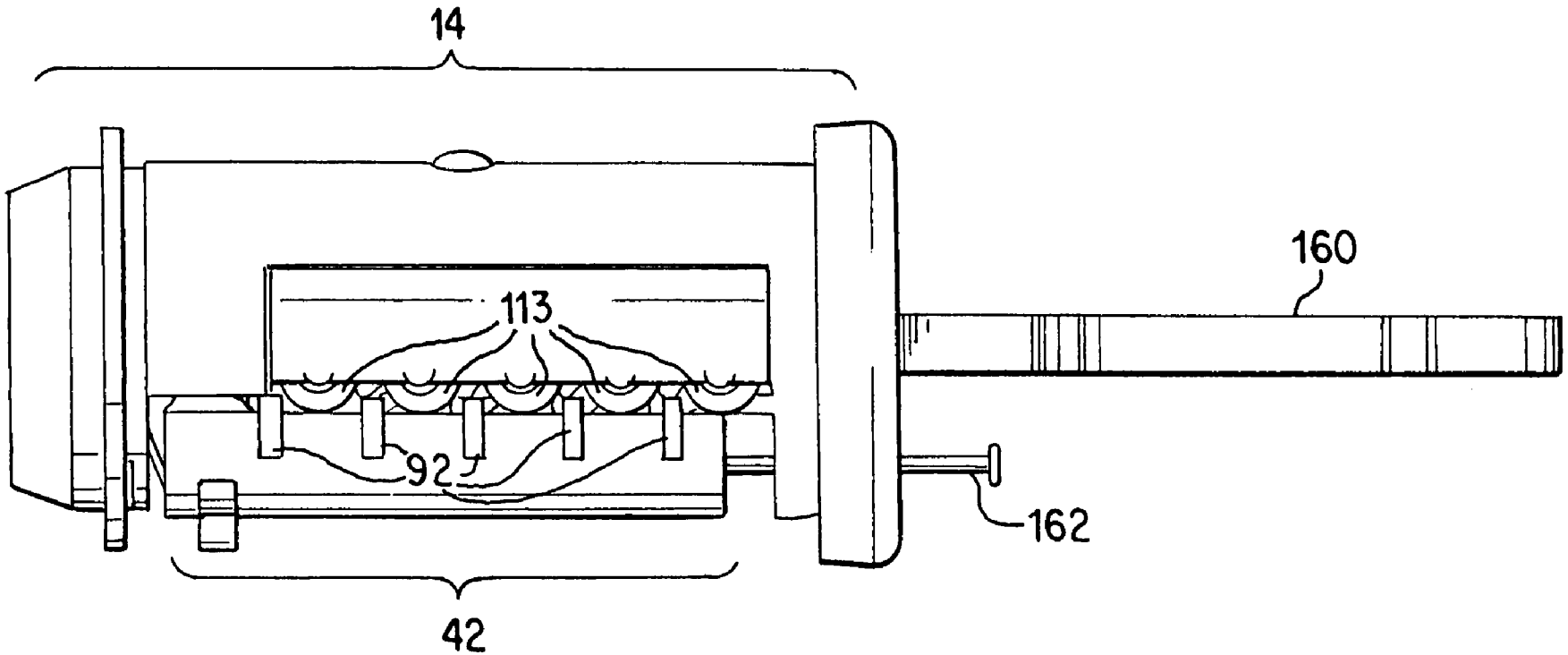
FIG. 14 is a top plan view of the plug assembly of FIG. 13.
Figure 15C:
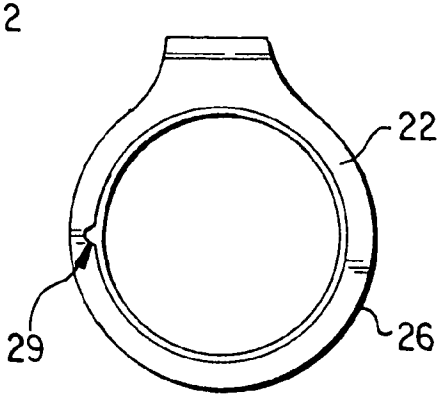
FIGS. 15*a*–15*e* are various views of a cylinder body for use in the present invention.
Figure 15B:
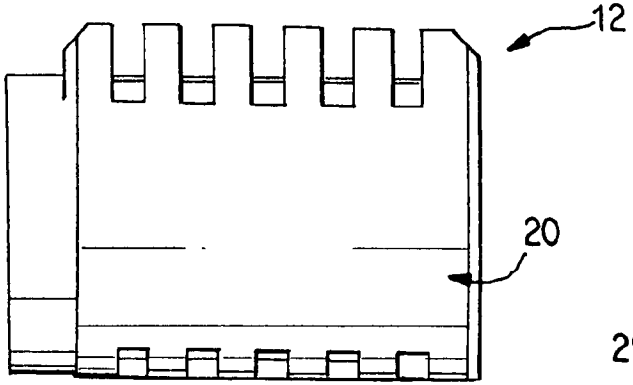
Figure 15A:
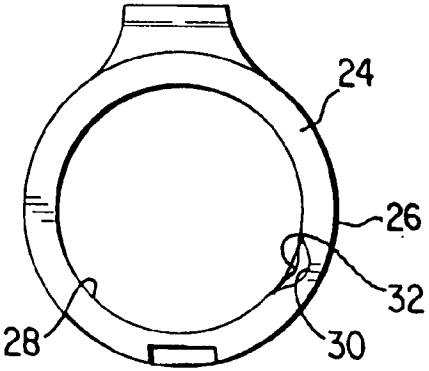
Figure 15E:
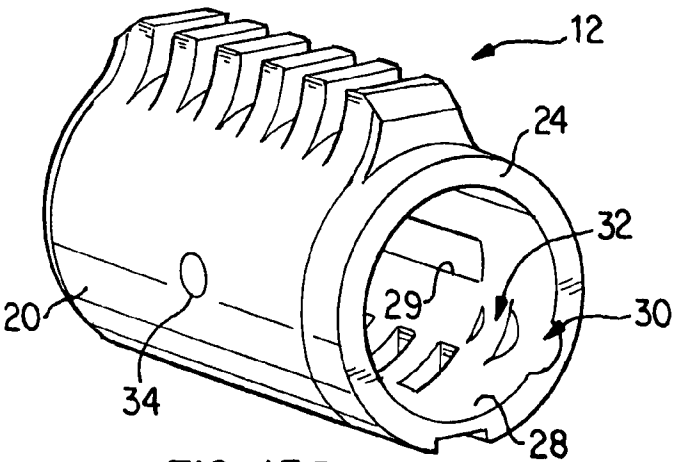
Figure 15D:
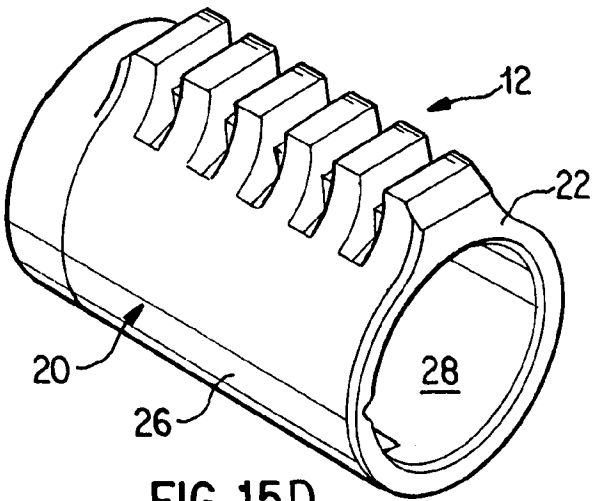
Figure 16A:
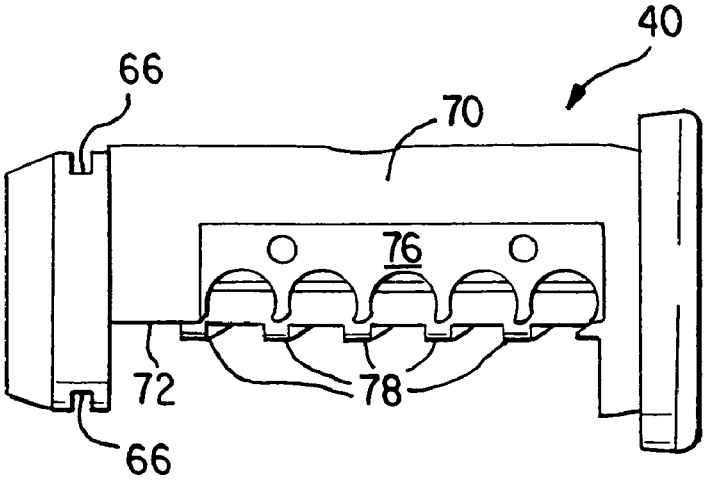
Figure 16B:
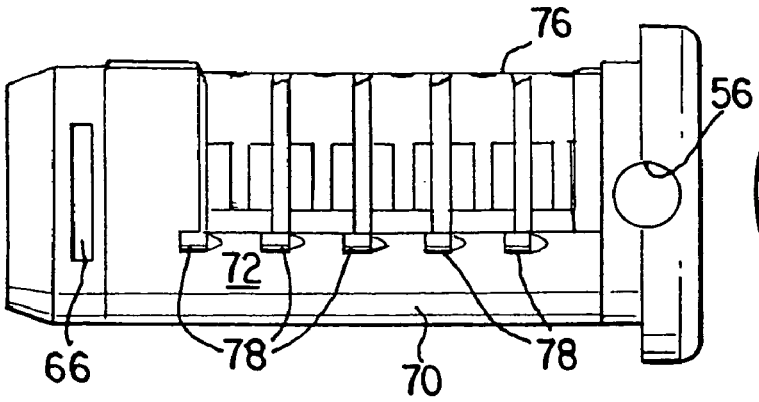
Figure 16C:
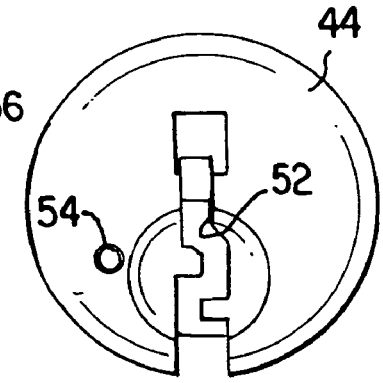

To rekey the lock cylinder 10, the valid key 160 is inserted into the keyway 52, as illustrated in FIGS. 13–14 and rotated approximately 45° counterclockwise from the home position until the spring catch 96 moves into the second detent recess 32 formed in the cylinder body 12. A paperclip or other pointed device 162 is inserted into the tool opening 54 and pushed against the carrier 90 to move the carrier 90 parallel to the longitudinal axis of the lock cylinder 10 until the spring catch 96 moves into the first detent recess 30, and the pointed device 162 is removed. With the spring catch 96 disposed in the first detent recess 30, the racks 92 are disengaged from the pins 113, as illustrated in FIG. 14. The valid key 160 is removed and a second valid key is inserted and rotated clockwise to release the spring catch 96. As the spring catch 96 leaves the first detent recess 30, the carrier 90 is biased toward the plug face 44 by the return spring 98, causing the racks 92 to re-engage the pins 113. At this point, the lock cylinder 10 is keyed to the second valid key and the first valid key 160 no longer operates the lock cylinder 10. The lock cylinder 10 can be rekeyed to fit a third valid key by replacing the first and second valid keys in the above procedures with the second and third valid keys, respectively.

Figure 23:
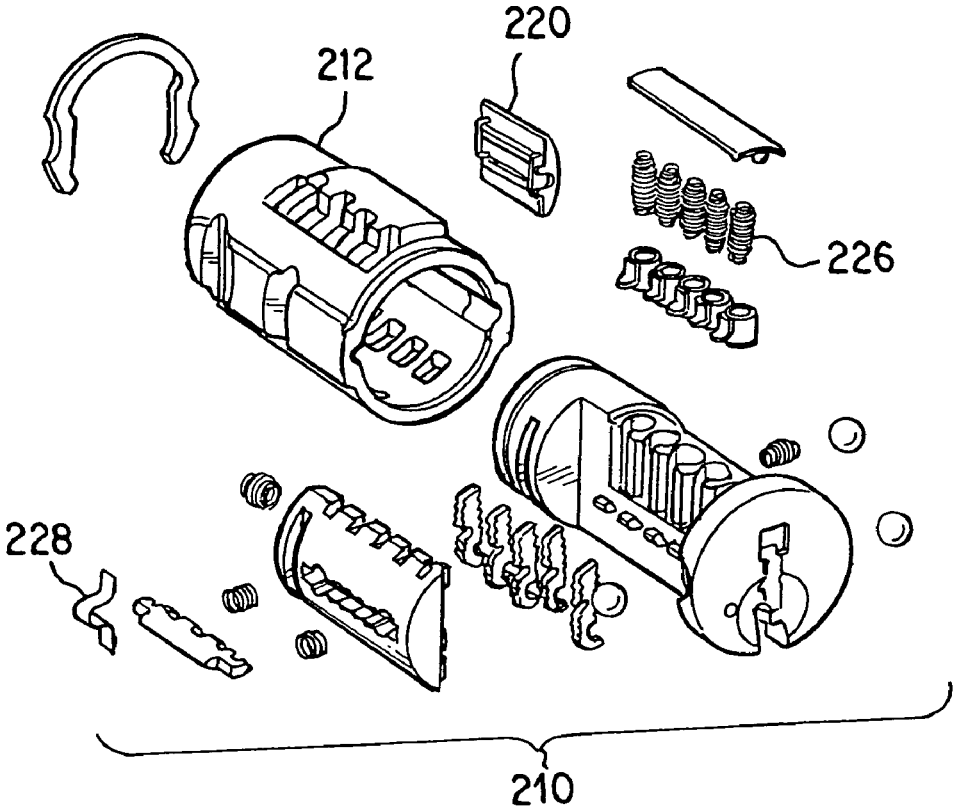
FIG. 23 is an exploded perspective view of an alternative embodiment of the invention.
Figure 24A:
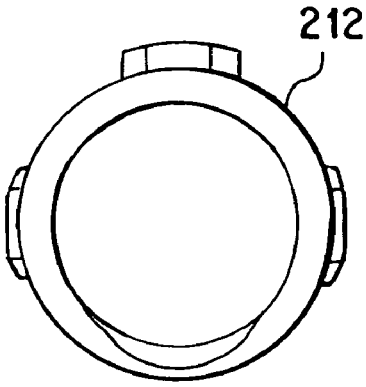
FIGS. 24*a*–24*e* are views of an alternative embodiment of the lock cylinder housing.
Figure 24B:
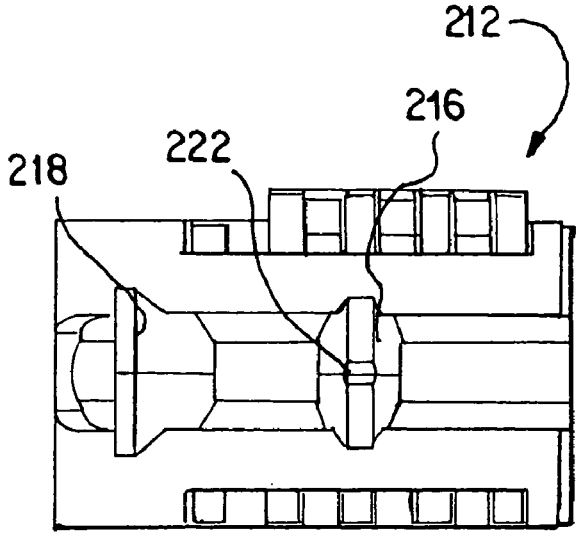
Figure 24C:
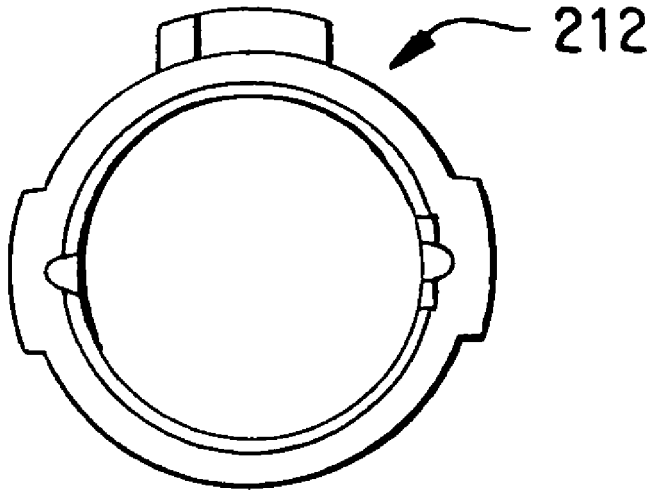
Figure 24D:
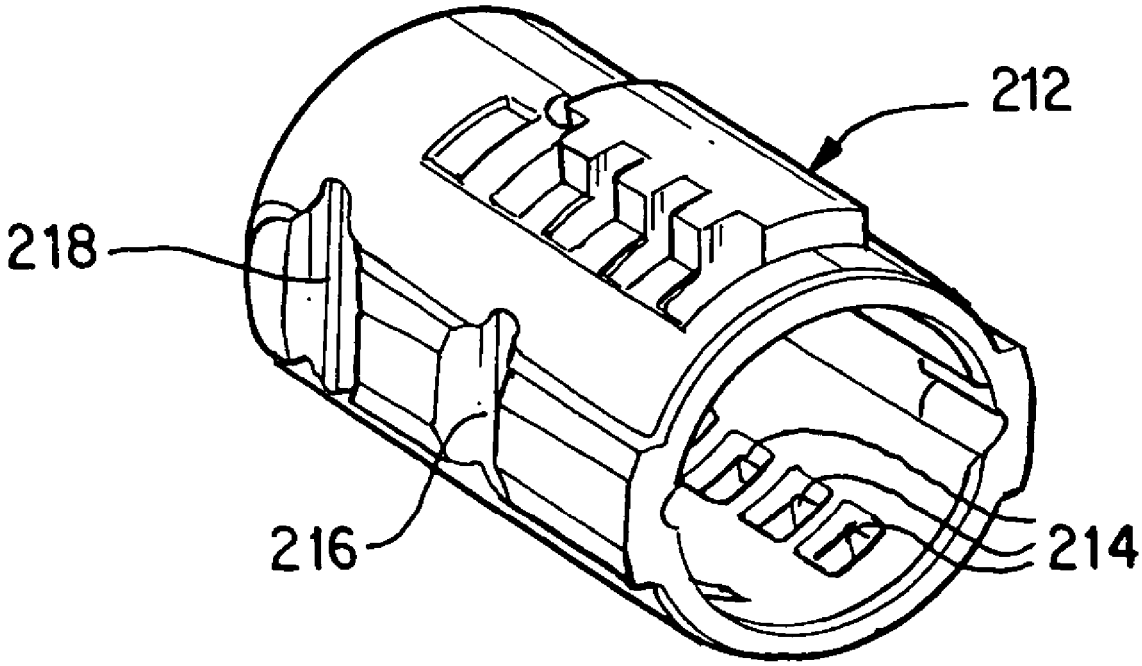
Figure 24E:
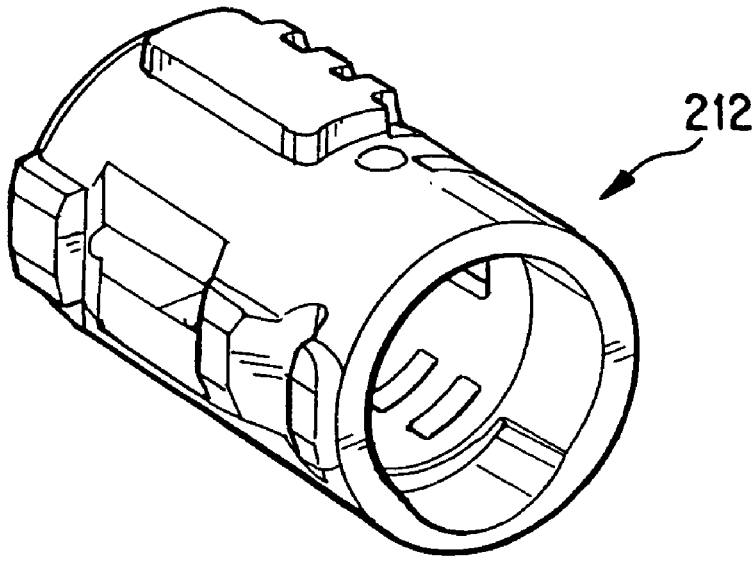

An alternative embodiment 210 of an exemplary embodiment of the present invention is illustrated in FIGS. 23–29. The alternative embodiment includes the same components, as illustrated in FIG. 23, but several of the components have been modified. Functionally, both embodiments are the same.

The modified housing 212, illustrated in FIGS. 23 and 24, includes a plurality of apertures 214 running longitudinally along the bottom thereof and a pair of vertical grooves 216, 218 formed in the housing sidewall. In addition, the sidewall includes a removable side panel 220. The rectangular holes 214 are positioned to allow the use of a manual override tool. The center groove 216 includes an aperture 222 extending through the housing sidewall. The aperture 222 allows a user to move the locking bar during a manual override operation. The side panel 220 provides access for performing certain operations while changing the master key of the lock cylinder.

Figure 25:
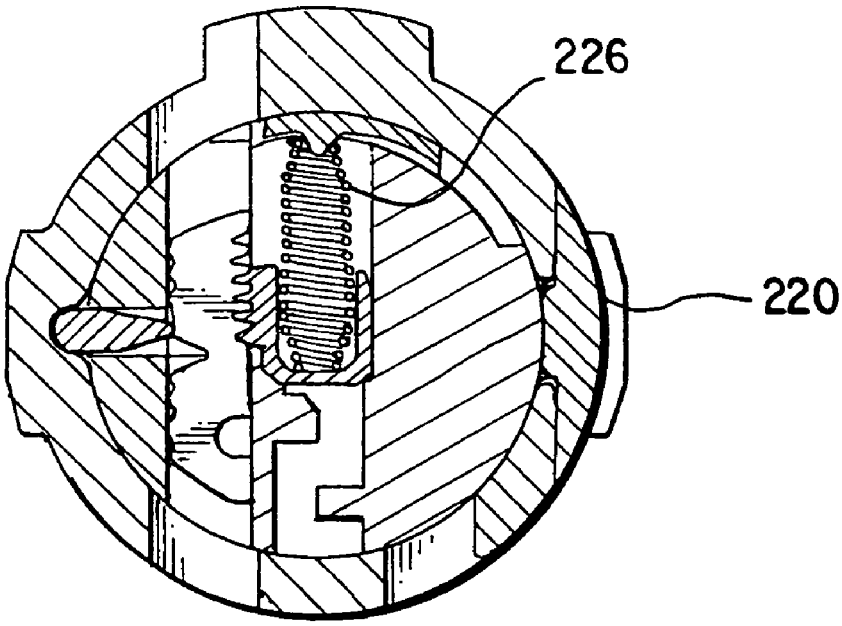
FIG. 25 is a transverse section view taken through an alternative embodiment of the present invention.

The modified pin biasing springs 226, illustrated in FIGS. 23 and 25, include a non-constant diameter, with the last few coils at each end of the springs 226 having a reduced diameter. The tapering allows for a greater spring force in a smaller physical height.

Figure 26A:
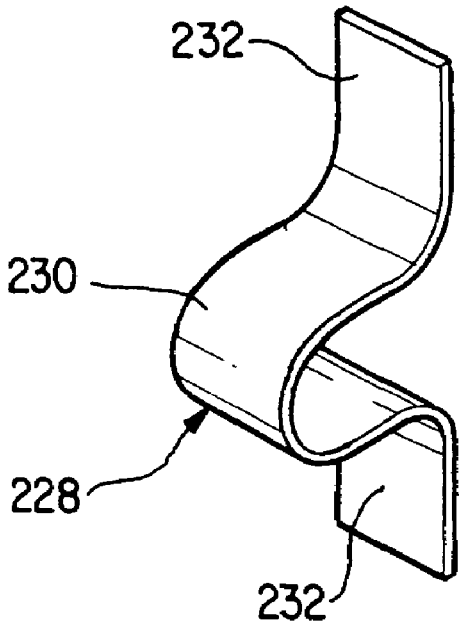
FIGS. 26*a*–26*b* are views of an alternative embodiment of the spring catch.
Figure 26B:
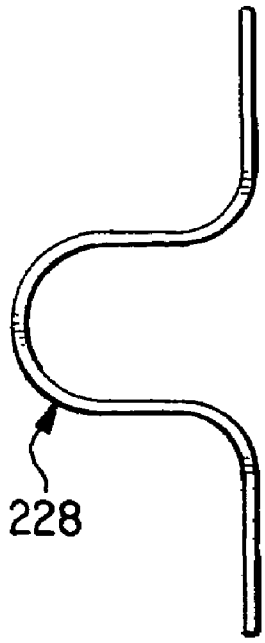
Figure 27A:
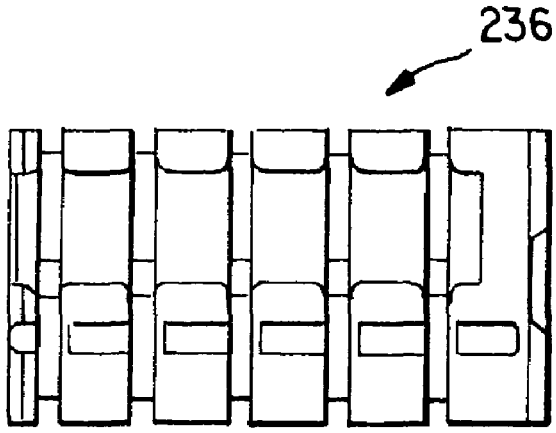
FIGS. 27*a*–27*e* are views of an alternative embodiment of the carrier.
Figure 27B:
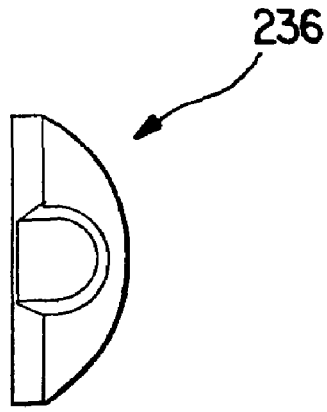
Figure 27C:
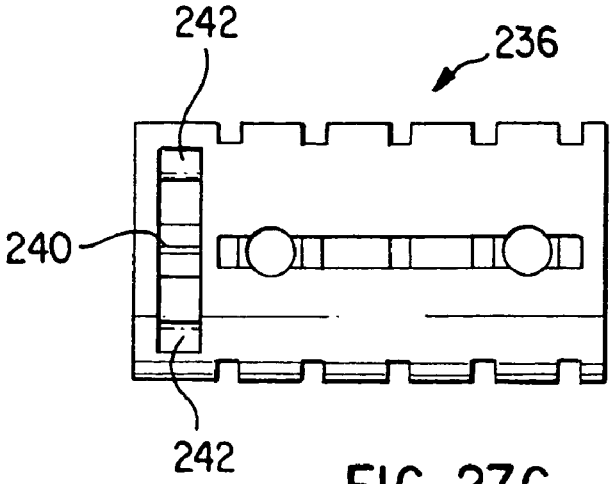
Figure 27D:
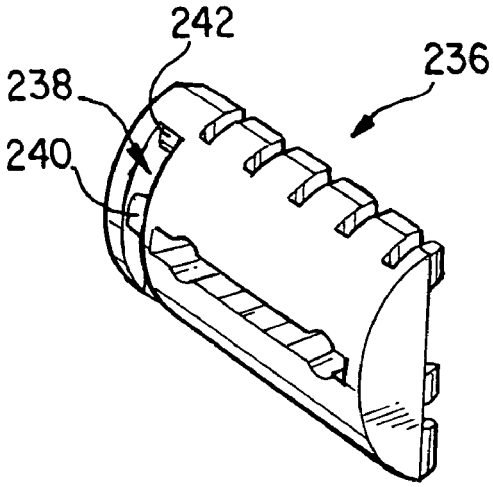
Figure 27E:
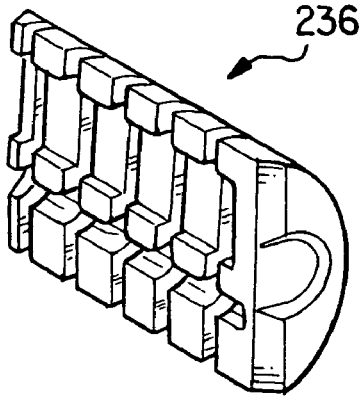

The modified spring catch 228, illustrated in FIGS. 23 and 26, includes a central U-shaped portion 230 and a pair of arms 232 extending from the U-shaped portion 230.

The modified carrier 236, illustrated in FIGS. 23 and 27, includes means for retaining the spring catch 228 in the spring catch recess 238. In the illustrated embodiment, this includes a guide 240 projecting outwardly in the center of the spring catch recess 238 and a pair of anchors 242 radially offset from the guide 240. The guide 240 prevents the spring catch 228 from moving transversely in the recess 238 while permitting it to move radially outwardly to engage the housing 12, 212 as described above. The anchors 242 engage the arms 232 of the spring catch 228 and prevent the arms 232 from splaying outwardly, thereby directing the compressive force of the spring catch 228 to extend the U-shaped portion 230 outwardly to engage the housing 12, 212.

The modified pins 244, illustrated in FIGS. 23 and 28, include a single gear tooth 246 instead of the plurality of gear teeth of the pins 113 described above. The single gear tooth 246, which preferably includes beveled sides 248, provides for a smoother engagement with the racks during the rekeying process.

The modified racks 250, illustrated in FIGS. 23 and 29, include beveled gear teeth to improve the engagement with the pins during the rekeying process. In addition, the pair of locking bar-engaging grooves 132 in the racks 92 are replaced with a single locking bar-engaging groove 251.

Figure 30A:
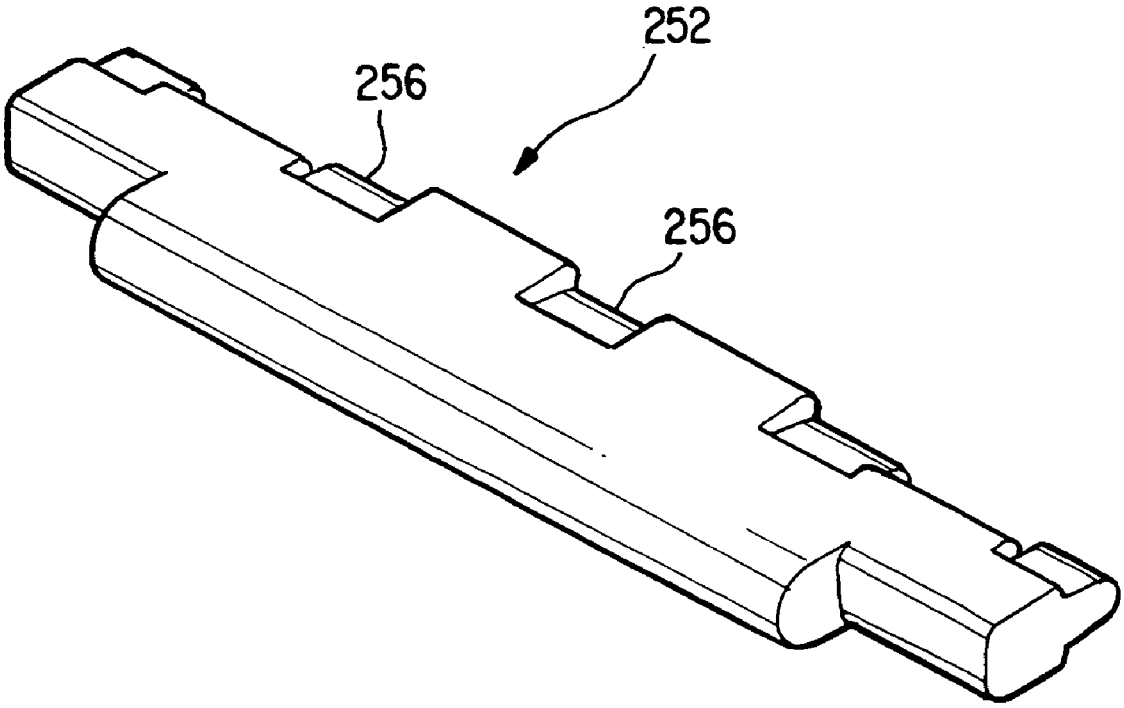
FIGS. 30*a*–30*b* are views of an alternative embodiment of the locking bar.
Figure 30B:
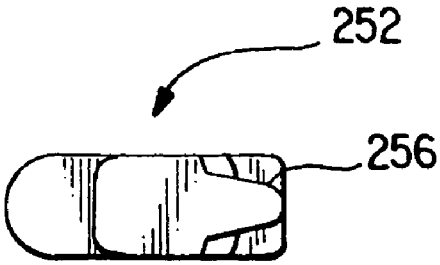

The modified locking bar 252, illustrated in FIGS. 23 and 30, is thinner than locking bar 94 and replaces the pair of gear teeth 136 with a single gear tooth 256 and rounds out the triangular edge 134. The thinner design reduces any rocking of the locking bar 252 in the locking bar recess 106.

Figure 31:
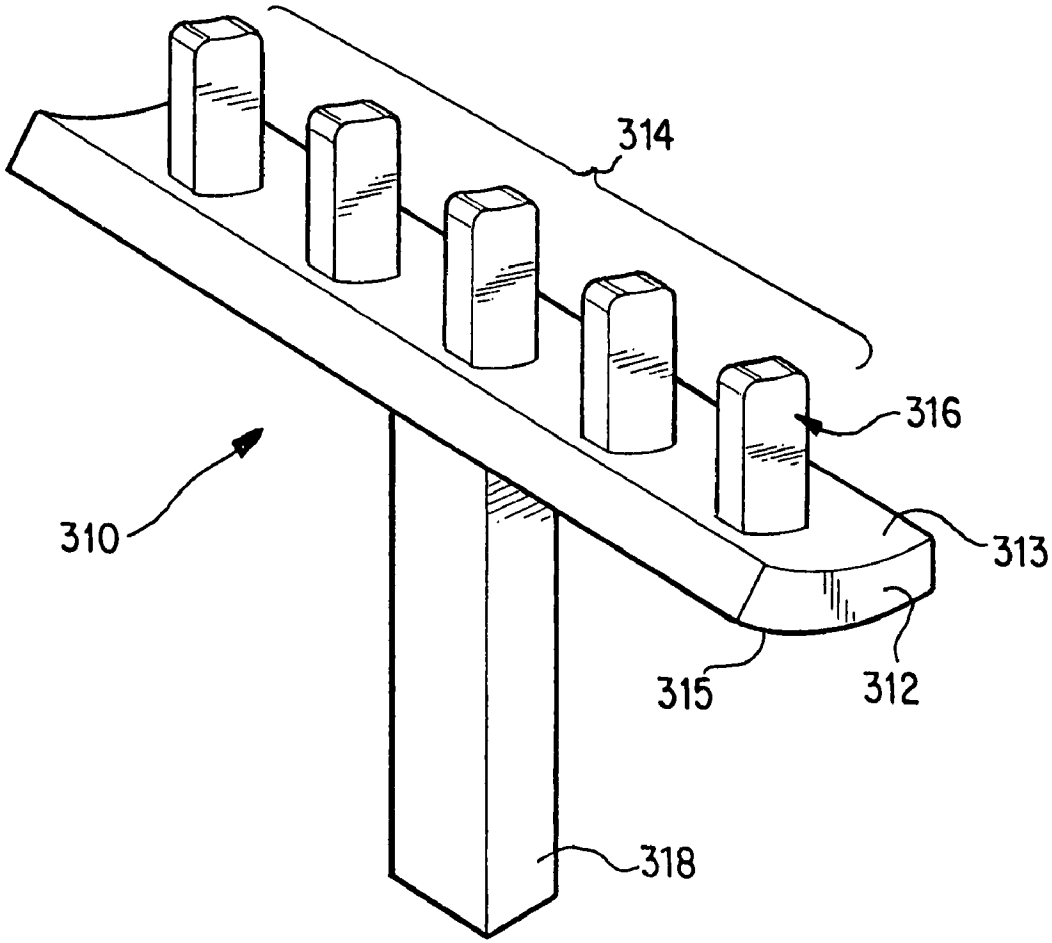
FIG. 31 is a perspective view of an exemplary embodiment of a rekeying tool of the present invention.

FIG. 31 is a perspective view of an exemplary embodiment of a manual override or rekeying tool 310, which can comprise a base 312 having, for example, a elongated approximately annular segment or elongated approximately toroidal segment shape. Attached to base 312 can be a plurality of prongs 314 each having, for example, an elongated approximately rectangular shape. Each of prongs 314 can be approximately perpendicularly attached to an inner surface 313 of base 312, and can have an end 316, that can have any shape that engages the a corresponding one of the plurality of racks 340 (shown in FIG. 34) of plug assembly 320, such as for example, a concave shape. To an outer surface 315 of base 312 can be attached a handle 318, having, for example, an elongated approximately rectangular shape. A longitudinal axis of handle 318 can be approximately perpendicular to and/or approximately parallel to a longitudinal axis of base 312. In an alternative embodiment (not shown), base 312 can have an elongated approximately rectangular shape, or any other shape, provided that base 312 serves to limit an insertion depth of rekeying tool 310 into the lock cylinder. As yet another alternative, another feature of tool 310 can limit its insertion depth.

Figure 32:
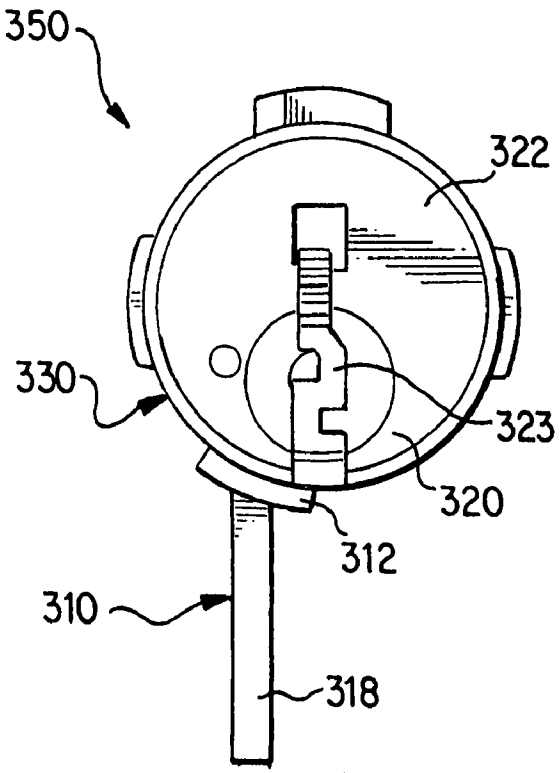
FIG. 32 is a front view of an exemplary embodiment of a rekeying tool of the present invention engaged with an exemplary embodiment of a lock cylinder of the present invention.
Figure 33:
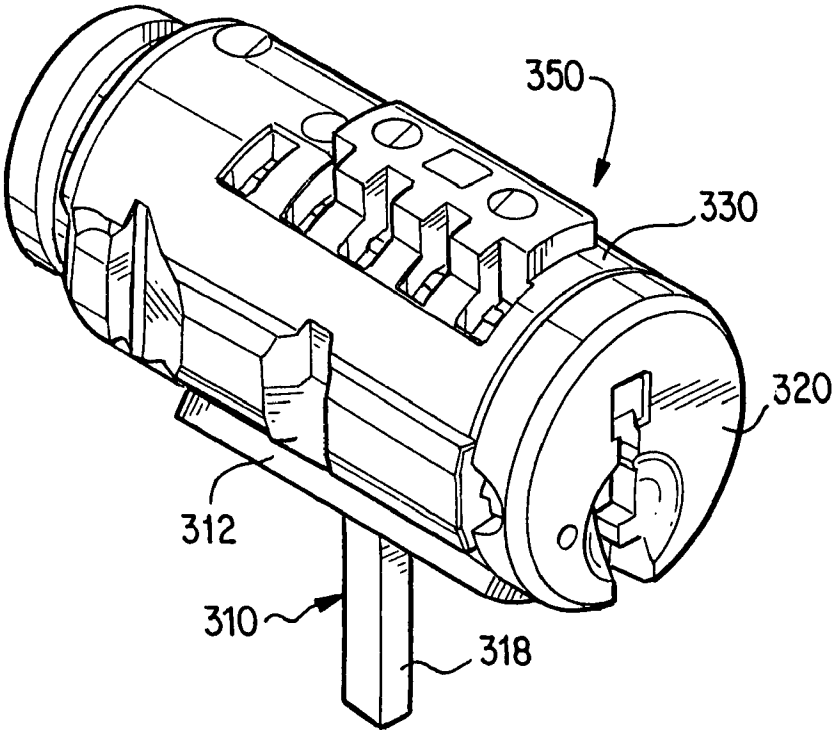
FIG. 33 is a perspective view of an exemplary embodiment of a rekeying tool of the present invention engaged with an exemplary embodiment of a lock cylinder of the present invention.

FIG. 32 is a front view, and FIG. 33 is a perspective view, of an exemplary embodiment of a rekeying tool 310 of the present invention engaged with an embodiment of a lock cylinder 350 of the present invention. Referring to FIGS. 32 and 33, rekeying tool 310 can be inserted into lock cylinder 350 along a direction, or such that handle 318 is, parallel to a keyway 323 defined through a plug face 322 of plug assembly 320. Base 312 can be configured to approximately conform to an outer surface of cylinder assembly 330.

Figure 34:
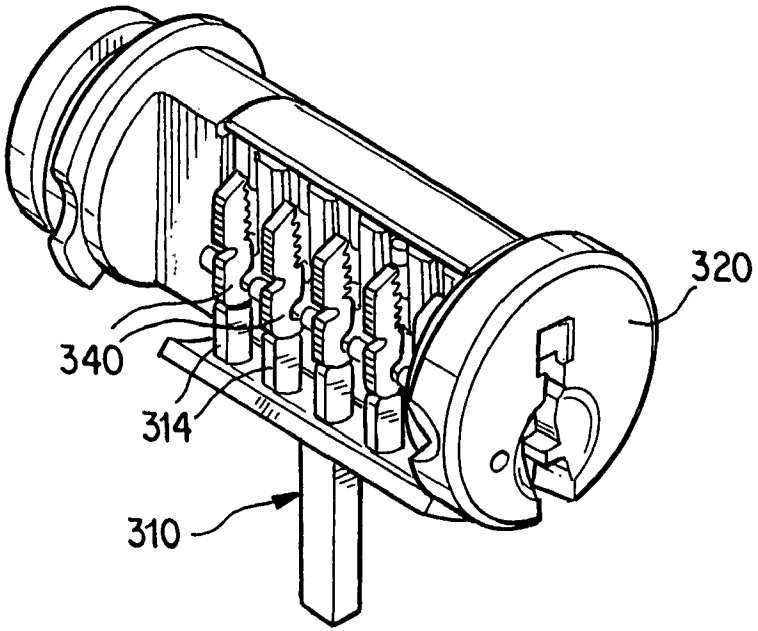
FIG. 34 is a partially exploded view of an exemplary embodiment of a rekeying tool of the present invention engaged with an exemplary embodiment of a lock cylinder of the present invention.

FIG. 34 is a partially exploded view of an exemplary embodiment of a rekeying tool 310 of the present invention engaged with an embodiment of a lock cylinder 350 of the present invention. Note that prongs 314 can engage with, and/or align to a common level, racks 340.

Figure 37:
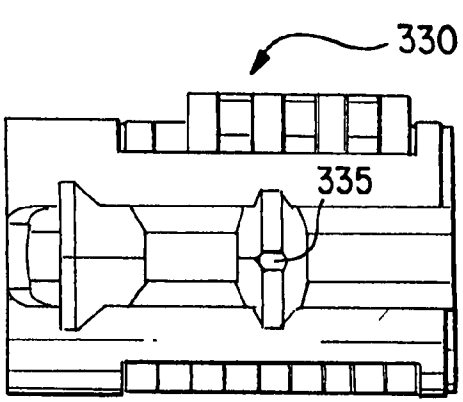
FIG. 37 is a top view of an exemplary embodiment of a cylinder body of the present invention.
Figure 36:
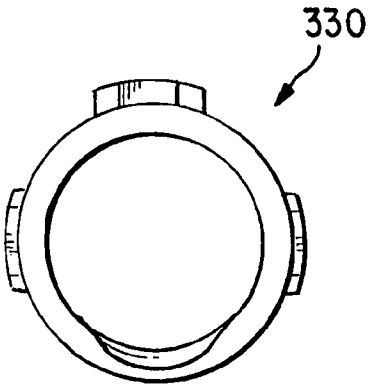
FIG. 36 is a rear view of an exemplary embodiment of a cylinder body of the present invention.
Figure 35:
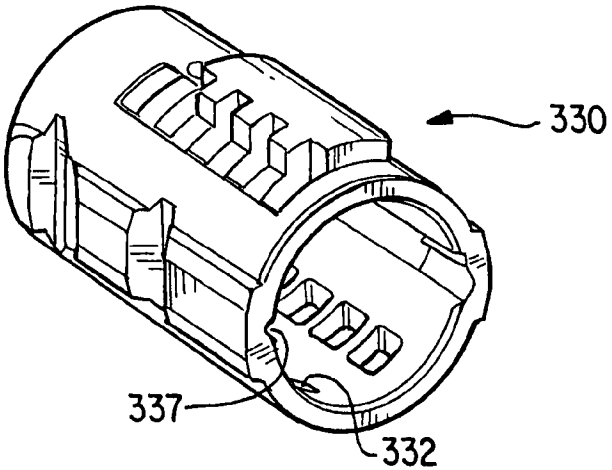
FIG. 35 is a front perspective view of an exemplary embodiment of a cylinder body of the present invention.
Figure 39:
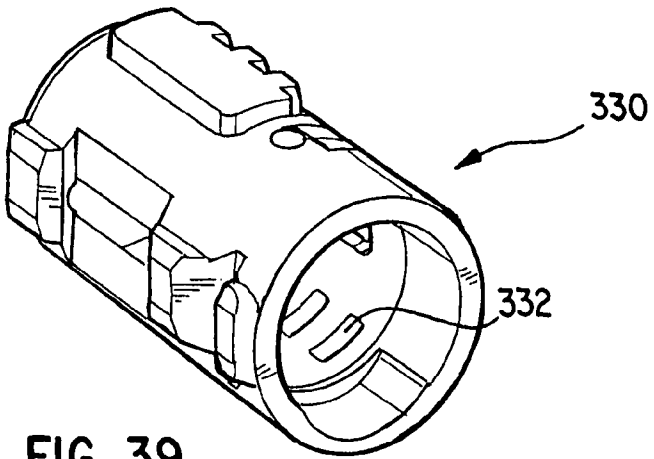
FIG. 39 is a rear perspective view of an exemplary embodiment of a cylinder body of the present invention.
Figure 38:
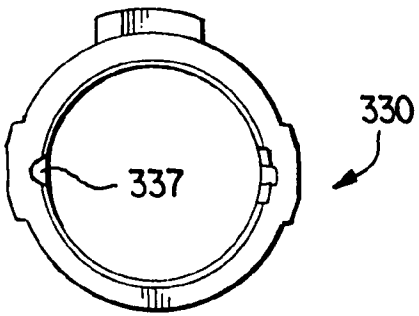
FIG. 38 is a front view of an exemplary embodiment of a cylinder body of the present invention.

FIG. 35 is a front perspective view, FIG. 36 is a rear view, FIG. 37 is a side view, FIG. 38 is a front view, FIG. 39 is a rear perspective view, of an exemplary embodiment of a cylinder body 330 of the present invention. Referring to FIGS. 34–39, cylinder body 330 can define a plurality of rekeying tool apertures 332 that can allow rekeying tool 310 to access the plurality of racks of plug assembly 320. Cylinder body 330 can also define a locking bar release tool aperture 335 via which a locking bar release tool 360 (shown in FIG. 40) can access and/or dislocate a locking bar 94 (shown at least in FIGS. 2, 3, 7, 8, 12, and 21A) from engaging with locking bar recess 337 of cylinder body 330.

Figure 40:
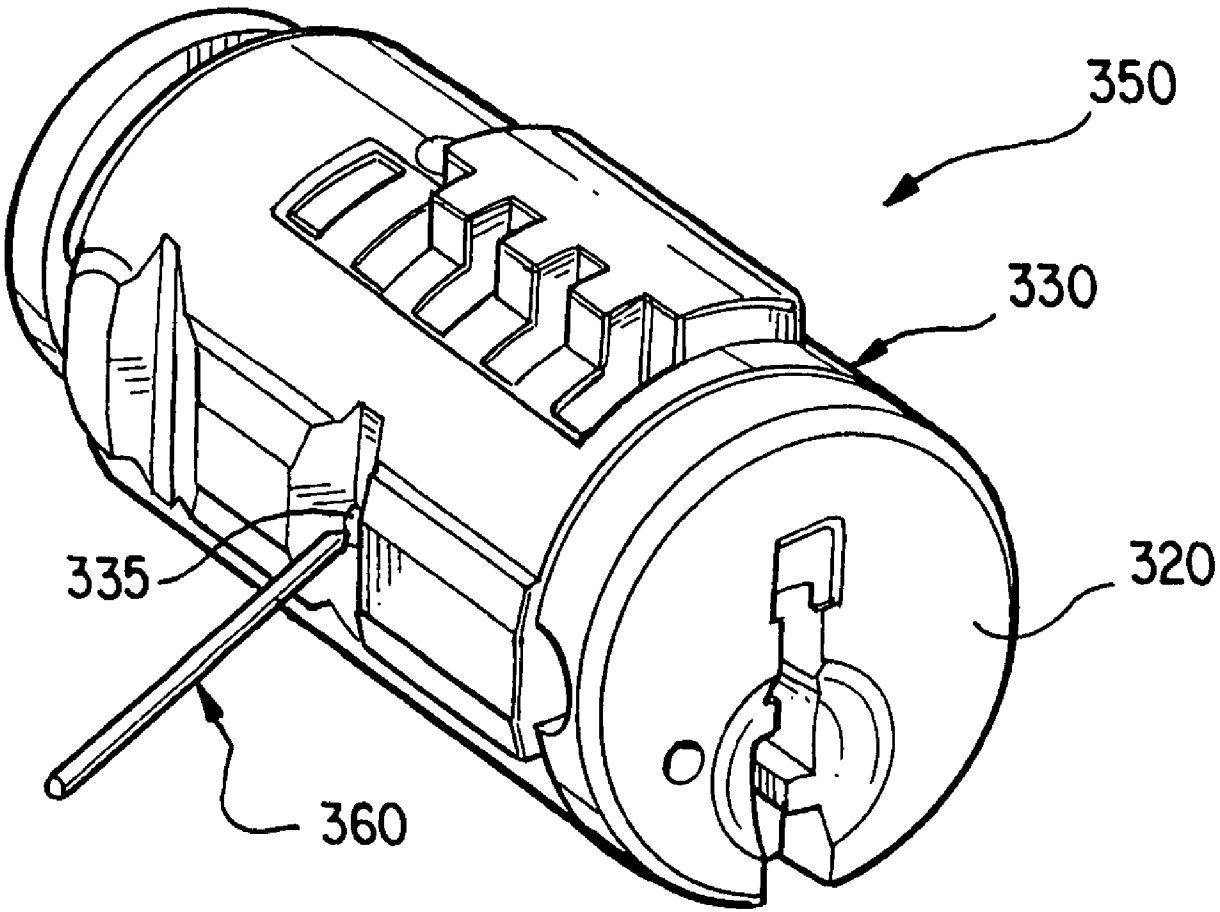
FIG. 40 is a perspective view of an exemplary embodiment of a carrier dislocation tool of the present invention engaged with an exemplary embodiment of a lock cylinder of the present invention.

FIG. 40 is a perspective view of an exemplary embodiment of a locking bar release tool 360 of the present invention engaged with an exemplary embodiment of a lock cylinder 350 of the present invention. Locking bar engagement tool 360, which can be as simple as a paperclip, can be inserted through locking bar engagement tool aperture 335 defined in cylinder body 330, such that locking bar 94 (shown at least in FIGS. 2, 4, 7, 8, 12, and 21A) can engage with racks 92 to align, restrict, and/or limit travel of, pins 113.

Figure 41:
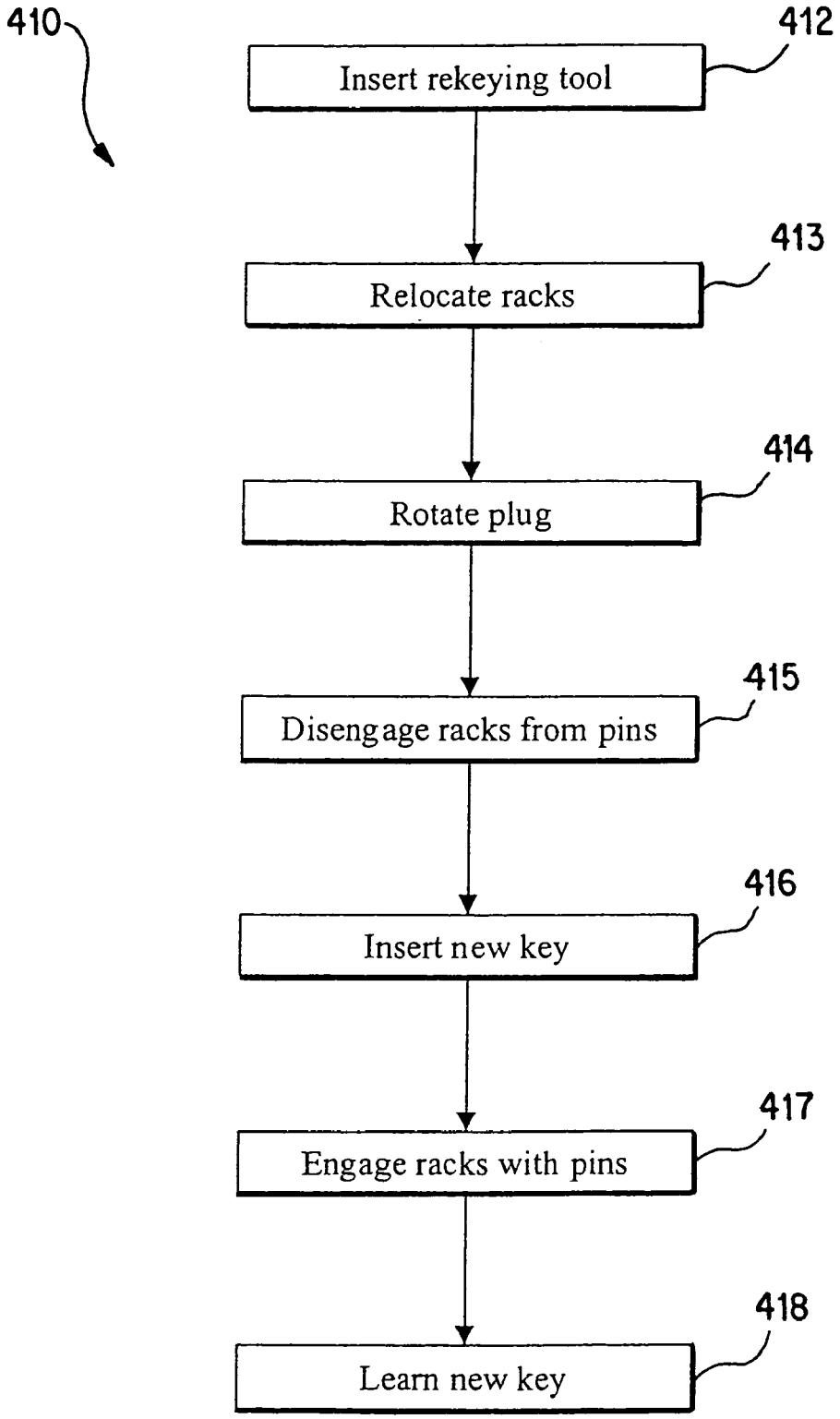
FIG. 41 is a flow chart of an exemplary embodiment of rekeying method of the present invention.

FIG. 41 is a flow chart of an exemplary embodiment of rekeying method 410 of the present invention. At activity 412, a rekeying tool can be inserted through one or more apertures of the cylinder body, such that the prongs of the rekeying tool engage the racks of the plug assembly. The insertion depth of the rekeying tool can be limited by the geometry of the rekeying tool, such as a shape of the base of the rekeying tool or a prong length, and/or the geometry of the cylinder body and/or plug assembly. For example, if the cylinder body has an elongated circular exterior, an interior and/or contact surface of the base of the rekeying tool can be shaped as an elongated annular segment, the inner radius of that segment approximately matching an outer radius of the cylinder body.

At activity 413, the rekeying tool can relocate the plurality of racks, such that the racks are aligned at a common level. For example, each rack can have a reference point, and full insertion of the rekeying tool can cause each reference point to align along a line parallel to an axis of the cylinder body and/or the plug assembly. As another example, referring to FIG. 12, each of the bullet-shaped features 78 can be aligned with the recesses 111 in the racks 92, allowing the racks 92, and the carrier 90, to move parallel to the longitudinal axis of the lock cylinder 10. Referring to FIGS. 12 and 40, with the racks 92 aligned, a locking bar engagement tool 360 can be inserted into a locking bar engagement tool aperture 335 in the cylinder body 330 to cause the locking bar 94 to engage with cut-outs in the racks 92, thereby preventing relative movement among the racks, and consequently, relative movement between the pins 113 engaged with the racks 92.

At activity 414, with the racks thus "locked" by the locking bar 94, the rekeying tool can be removed from the lock assembly. Then, the plug assembly can be rotated within the cylinder body to a learn position. This rotation can occur without requiring the use of a valid key, and preferably occurs with use of any key. Referring to FIGS. 13 and 14, as the plug assembly is rotated approximately 45 degrees to approximately 90 degrees counterclockwise the locking bar is retained in engagement with the racks.

At activity 415, with the plug assembly in the learn mode, the racks can be disengaged from the pins by pushing the racks away from the pins. Referring to FIGS. 13 and 14, a carrier relocation tool, such as a paperclip or other pointed device 162, can be inserted into the tool opening 54 and pushed against the carrier 90 to move the carrier 90 parallel to the longitudinal axis of the lock cylinder 10 until the spring catch 96 moves into the first detent recess 30, and the pointed device 162 is removed. With the spring catch 96 disposed in the first detent recess 30, carrier 90 is locked in place by the spring catch 96, the racks 92 are disengaged from the pins 113, and the racks 92 are locked in place by the bullet-shaped features 78 (shown in FIG. 6).

At activity 416, a new key can be inserted into the keyway of the plug assembly. As the new key is inserted, the pins can ride up and down the ramps of the key. Once the key is fully inserted, the pin heights can correlate to the new key.

At activity 417, the racks can be re-engaged with the pins. Referring to FIGS. 13 and 14, the new key can be rotated clockwise to release the spring catch 96. As the spring catch 96 leaves the first detent recess 30, the carrier 90 is biased toward the plug face 44 by the return spring 98, causing the racks 92 to re-engage the pins 113. At this point, the lock cylinder 10 is keyed to the new key (i.e., the "new" key) and any previously valid key 160 no longer operates the lock cylinder 10. Thus, the new key can be learned by rotating the plug assembly away from the learn position.

Thus, via the rekeying tool, without requiring a valid key, the lock assembly can be placed into a learn mode, in which it can read and conform to a profile of a new key, without removing the plug assembly from the cylinder body.

Figure 42:
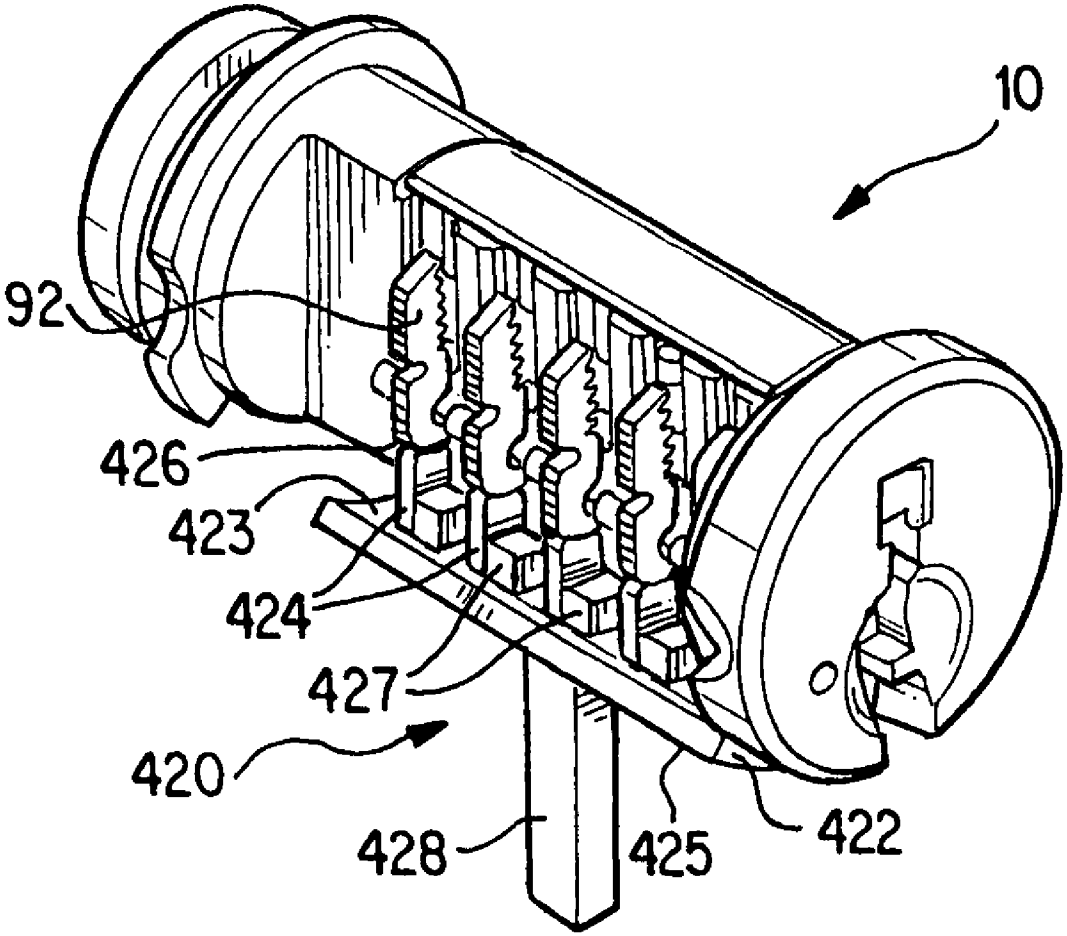
FIG. 42 is a partially exploded view of an exemplary embodiment of a keying tool of the present invention engaged with an exemplary embodiment of a lock cylinder of the present invention.

FIG. 42 is a partially exploded view of an exemplary embodiment of a keying tool 420 of the present invention engaged with an exemplary embodiment of a lock cylinder 10 of the present invention. Keying tool 420 can be used to configure a lock cylinder to suit any appropriate key cut (occasionally a.k.a. "bit spacing"), including a competitor's key cut.

Keying tool 420 can be substantially identical to rekeying tool 310 (shown in FIG. 31), except that keying tool 420 can comprise a carrier retainer 427, that is shaped and/or dimensioned to at least partially fill its corresponding tool aperture 332 in cylinder body 330 (shown in FIG. 39), for instance while longitudinal ends 426 of keying tool's prongs 424 are engaged in rack apertures 103 (shown in FIG. 17A) in a dislocated carrier assembly 42 (shown at least in FIGS. 2, 4, 14).

Thereby, referring to FIGS. 2 and 42, keying tool 420 can prevent the dislocated carrier assembly 42 whose racks 92 are unengaged (possibly because they have not yet been inserted into carrier assembly 42) with their corresponding pins 113, from moving with respect to cylinder body 12 and/or from returning to its original position. That is, via insertion of keying tool 420 into a lock cylinder 10, a carrier assembly 42 that has been moved from a "normal" position to a "dislocated" position can be retained in place with respect to the cylinder body 12, thereby allowing racks 92 that are inserted into the carrier assembly 42 to remain unengaged from pins 113 until the carrier retainer portion 427 of keying tool 420 is removed from, and/or no longer at least partially fills, its corresponding aperture in cylinder body 12, and/or until keying tool 420 is removed from the lock cylinder 10. Keying tool 420 can also align the inserted racks 92 and/or a feature on the inserted racks 92 to a predetermined level.

Keying tool 420 can comprise a base 422 having, for example, an elongated annular segment or elongated toroidal segment shape. Attached to base 422 can be a plurality of prongs 424 each having, for example, an elongated approximately rectangular shape. Each of prongs 424 can be approximately perpendicularly attached to an inner surface 423 of base 422, and can have, for example, a concavely shaped end 426. To an outer surface 425 of base 422 can be attached a handle 428, having, for example, an elongated rectangular shape. A longitudinal axis of handle 428 can be approximately perpendicular to and/or approximately parallel to a longitudinal axis of base 422. In an alternative embodiment (not shown), base 422 can have an elongated rectangular shape, or any other shape, provided that base 422 serves to limit an insertion depth of keying tool 420 into the lock cylinder. As yet another alternative, another feature of tool 420, such as carrier retainer 427, can limit its insertion depth.

Each carrier retainer 427 can be adjacent, contiguous, and/or integral with a prong 424, and can have, for example, an elongated rectangular shape. The length of each carrier retainer 427 can be less than its corresponding prong 424. A combined width of each prong/carrier retainer, as measured in a direction parallel to the longitudinal axis of the plug body and/or along a line where the prong and carrier retainer combination attach to base 422, can be greater than a width of the prong 424. Referring to FIGS. 34–39, the orientation and width of at least one prong and carrier retainer combination can be sufficient to substantially fill at least the width of its corresponding rekeying tool aperture 332 in cylinder body 330, thereby preventing a dislocated carrier assembly 42 (shown at least in FIGS. 2, 4, 14) from returning to its original position.

Figure 28A:
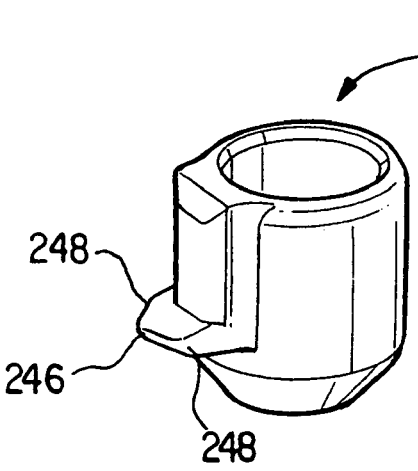
FIGS. 28*a*–28*b* are views of an alternative embodiment of the pin.
Figure 28B:
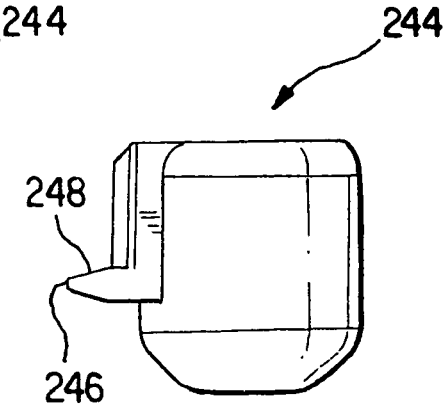
Figure 29A:
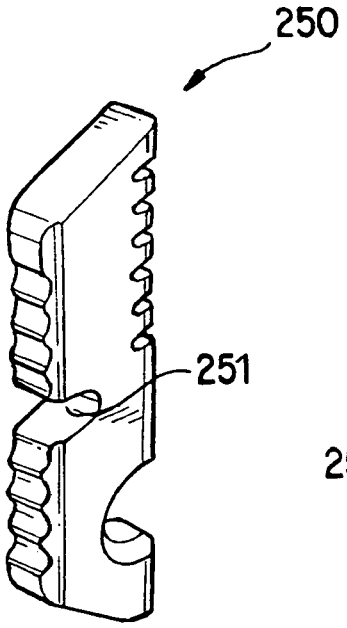
FIGS. 29*a*–29*b* are views of an alternative embodiment of the rack.
Figure 29B:
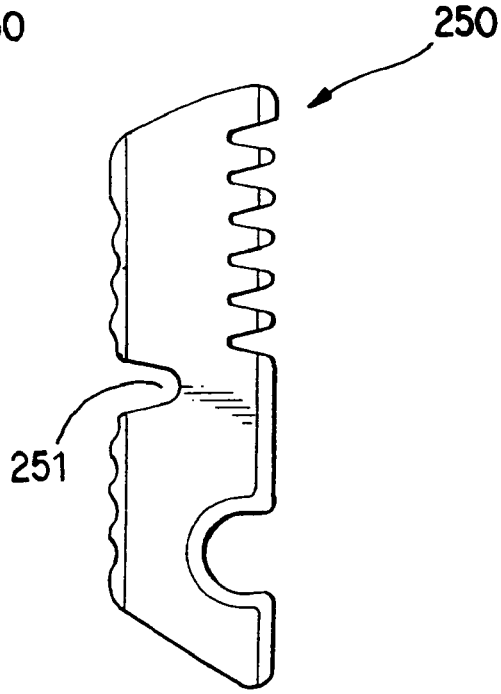

As shown in FIGS. 28A and 28B, pin 244 can comprise standardized dimensions and shape, and can comprise a single tooth 246, located in a standard position. As shown in FIGS. 29A and 29B, rack 250 can have a tooth profile that meshes with pin 246, and having a spacing that corresponds to depth increments (occasionally a.k.a. "bit spacing") of the key cut. The tooth spacing of rack 250 can be customized to a particular manufacturer, brand, or model of key and/or lock assembly. For example, Schlage keys and locksets tend to have an 11 mil key cut increment, while Kwikset tends to use a 15 mil key cut increment. Thus, a rack 250 that is intended for use with a Schlage key could have an 11 mil tooth spacing, and a rack 250 that is intended for use with a Kwikset key could have a 15 mil tooth spacing.

Alternatively, either of two standard racks could be selected to correspond to a particular key cut depth. For example, assuming that Kwikset tends to use a 15 mil key cut increment, a first standard Kwikset rack A could have one or more tooth engagements zones (e.g., valleys) at, for instance, 15 mils, 45 mils, and 75 mils, as measured from a convenient location, such as one end of the rack. A second standard Kwikset rack B could have valleys at 30 mils, 60 mils, and 90 mils. Depending on the depth of a particular key's cut for a given pin, the appropriate rack could be chosen. So if a key had a cut depth of 60 mils, a rack B could be selected and used for the corresponding pin.

Figure 43:
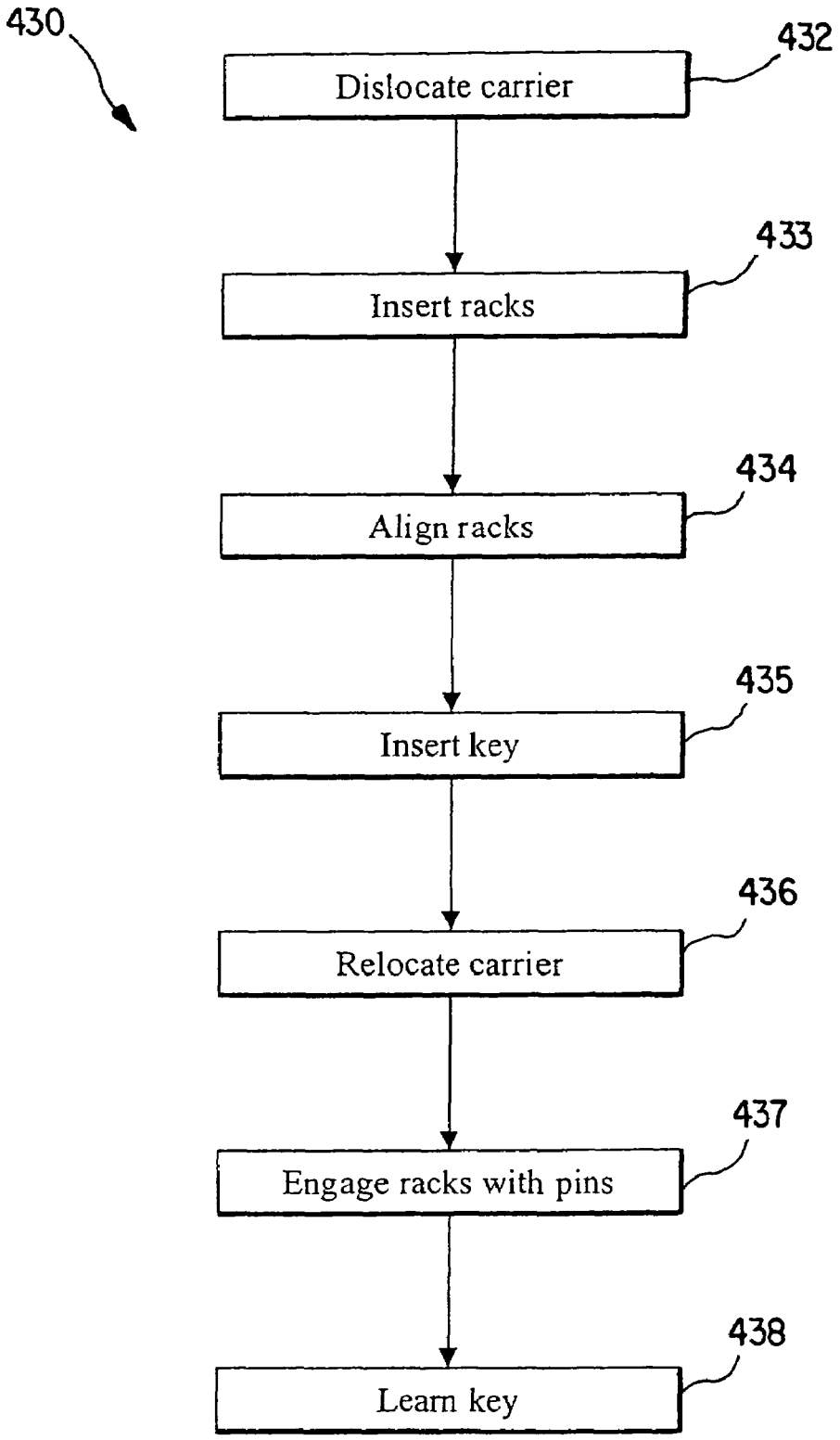
FIG. 43 is a flow chart of an exemplary embodiment of keying method of the present invention.

FIG. 43 is a flow chart of an exemplary embodiment of keying method 430 of the present invention.

At activity 432, the rack carrier can be pushed away from the pins, such that it moves from a "normal" position to a "dislocated" position. This can be accomplished by inserting a carrier relocation tool, such as a paperclip, into a carrier relocation tool aperture found in a front face of the plug, such that the tool engages and pushes the carrier backward. With the carrier dislocated, a keying tool and/or rack alignment tool, such as that shown in FIG. 42, can be inserted into apertures in the cylinder body. Because the keying tool can retain the carrier in the dislocated position, the carrier relocation tool can now be removed.

The insertion depth of the keying tool can be limited by the geometry of the keying tool, such as a shape of the base of the keying tool or a prong length, and/or the geometry of the cylinder body and/or plug assembly. For example, if the cylinder body has a elongated circular exterior, an interior and/or contact surface of the base of the keying tool can be shaped as an elongated annular segment, the inner radius of that segment approximately matching an outer radius of the cylinder body.

At activity 433, the racks can be selected, potentially to correspond to a manufacturer, brand, and/or model of key and/or lock assembly, and/or to correspond to a key cut. The selected racks can be inserted into their respective slots of the carrier assembly. At activity 434, the keying tool can align the inserted racks.

At activity 435, a key can be inserted into the keyway of the plug assembly. As the key is inserted, the pins can ride up and down the ramps of the key to land and/or align with flats of the key. Once the key is fully inserted, the heights of the pins and/or the pin teeth can correlate to the profile of the key.

At activities 436 and 437, the racks can be engaged with the pins by removing the keying tool, such that the carrier spring biases and/or relocates the carrier back into its "normal" position.

At activity 438, the key can be learned by rotating the plug assembly away from the learn position.

Thus, via the keying tool, the lock assembly can be assembled to conform to a profile of a key, without removing the plug assembly from the cylinder body.

The above-described exemplary embodiments, of course, are not to be construed as limiting the breadth of the present invention. Modifications and other alternative constructions will be apparent that are within the spirit and scope of the invention as defined in the appended claims.

What is claimed is:

1. A lock keying system comprising:

a lock cylinder comprising:

a cylinder body;

a plug assembly disposed in said cylinder body and comprising a plurality of pins and a one-to-one corresponding plurality of racks for relocating said plurality of pins; and a rack alignment tool receiving aperture defined by said lock cylinder; and a rack alignment tool comprising:

a base plate; and a plurality of spaced elongated prongs, each prong from said plurality of prongs comprising a first longitudinal end adapted to engage a corresponding one of said plurality of racks, each prong from said plurality of prongs dimensioned lengthwise to relocate to a first predetermined position said corresponding one of said plurality of racks, said first predetermined position common to each of said plurality of racks, each prong from said plurality of prongs comprising a second longitudinal end connected to said base plate, wherein said rack alignment tool is adapted to restrain a carrier assembly comprising said plurality of racks in an unengaged position wherein said plurality of racks are unengaged with said plurality of pins.

2. The lock keying system of claim 1, wherein each of said plurality of prongs has a substantially identical length.

3. The lock keying system of claim 1, wherein an insertion distance of said plurality of prongs constrained by a contact of said base plate with said lock cylinder.

4. The lock keying system of claim 1, wherein for each rack of said plurality of racks, a longitudinal axis of said rack is parallel to and non-coaxial with a longitudinal axis of said rack's corresponding pin.

5. The lock keying system of claim 1, wherein said plug assembly further comprises a carrier assembly moveable parallel to a longitudinal axis of the cylinder body, said carrier assembly comprising said plurality of racks.

6. The lock keying system of claim 1, wherein each pin comprises at least one tooth.

7. The lock keying system of claim 1, wherein each rack comprises at least one tooth.

8. The lock keying system of claim 1, wherein each rack comprises at least one tooth spaced a predetermined distance from an end of said rack.

9. The lock keying system of claim 1, wherein each rack comprises at least one tooth spaced a predetermined distance from an end of said rack, said distance dependent on a lock brand.

10. The lock keying system of claim 1, wherein each rack comprises at least one tooth spaced a predetermined distance from an end of said rack, said distance dependent on a manufacturer's key depth.

11. A lock keying tool for a lock cylinder comprising a cylinder body and a plug assembly disposed in the cylinder body and comprising a plurality of pins and a one-to-one corresponding plurality of racks for relocating the pins, said lock cylinder defining a tool-receiving aperture, said lock keying tool comprising:

a base plate defining a first face and a second face, said first face opposing said second face;

a plurality of spaced elongated prongs, each prong from said plurality of prongs comprising a concave first longitudinal end disposed on a first portion of said prong and adapted to engage a corresponding one of the plurality of racks, each prong from said plurality of prongs defining a longitudinal axis and longitudinally dimensioned to relocate to a first predetermined position the corresponding one of the plurality of racks, the first predetermined position common to each of the plurality of racks, each prong from said plurality of prongs comprising a second longitudinal end disposed on a second portion of said prong and connected to said base plate; and a handle connected to said second face of said base plate.

12. The lock keying tool of claim 11, wherein each of said prongs is perpendicularly connected to said first face.

13. The lock keying tool of claim 11, wherein each of said plurality of prongs has a substantially identical length.

14. The lock keying tool of claim 11, wherein said first face is parallel to said second face.

15. The lock keying tool of claim 11, wherein said base plate defines a segment of an annulus.

16. The lock keying tool of claim 11, wherein said handle is perpendicularly connected to said second face of said base plate.

* * * * *